US010703518B2

(12) United States Patent
Ceré

(10) Patent No.: US 10,703,518 B2
(45) Date of Patent: Jul. 7, 2020

(54) WRAPPING MACHINE

(71) Applicants: AETNA GROUP S.P.A., Verucchio (RN) (IT); ROBOPAC S.P.A., Acquaviva-Gualdicciolo (SM)

(72) Inventor: Mauro Ceré, Loiano (IT)

(73) Assignees: AETNA GROUP S.P.A., Verucchio (RN) (IT); ROBOPAC S.P.A., Acquaviva Gualdicciolo (SM)

( * ) Notice: Subject to any disclaimer, the term of this patent is extended or adjusted under 35 U.S.C. 154(b) by 237 days.

(21) Appl. No.: 15/577,663

(22) PCT Filed: May 27, 2016

(86) PCT No.: PCT/IB2016/053118

§ 371 (c)(1),
(2) Date: Nov. 28, 2017

(87) PCT Pub. No.: WO2016/193878

PCT Pub. Date: Dec. 8, 2016

(65) Prior Publication Data

US 2018/0290776 A1 Oct. 11, 2018

(30) Foreign Application Priority Data

May 29, 2015 (IT) ..... 102015000019513

(51) Int. Cl.
*B65B 11/02* (2006.01)
*B65B 21/24* (2006.01)
(Continued)

(52) U.S. Cl.
CPC ..... *B65B 11/025* (2013.01); *B65B 11/58* (2013.01); *B65B 21/245* (2013.01); *B65B 35/44* (2013.01);
(Continued)

(58) Field of Classification Search
CPC ..... B65B 11/008; B65B 11/025; B65B 11/58; B65B 21/245; B65B 41/14; B65B 35/44;
(Continued)

(56) References Cited

U.S. PATENT DOCUMENTS 3,233,385 A * 2/1966 Lyon ..... B65B 13/10 53/588
3,864,191 A * 2/1975 Tovarys ..... B65B 27/105 156/468
(Continued)

FOREIGN PATENT DOCUMENTS

DE 39 10 823 10/1990
EP 0428852 A1 * 5/1991 ..... B65B 11/105
(Continued)

OTHER PUBLICATIONS

International Search Report dated Dec. 7, 2016 in International (PCT) Application No. PCT/IB2016/053118.
(Continued)

*Primary Examiner* — Stephen F. Gerrity
(74) *Attorney, Agent, or Firm* — Wenderoth, Lind & Ponack, L.L.P.

(57) ABSTRACT

A wrapping machine for wrapping groups of products with an extensible plastic film to form bundles includes a conveyor for supporting and moving a group of products along an advancing direction inside the wrapping machine, a supporting device for supporting the group of products received from the conveyor, a wrapping unit for wrapping a portion of film around the group of products, supported by the supporting device, in order to form a bundle, and a supplying unit to supply the wrapping unit with the film portion separated from the film. The supporting device includes a gripping device that holds an initial flap of the film portion during the wrapping of the group of products, a containment device to abut against the group of products
(Continued)

to guide the products when moved along the advancing direction through the wrapping unit and/or to support and restrain the group of products during wrapping.

20 Claims, 18 Drawing Sheets

(51) Int. Cl.

| | |
|---|---|
| ***B65B 35/44*** | (2006.01) |
| ***B65B 11/58*** | (2006.01) |
| ***B65B 41/14*** | (2006.01) |
| ***B65B 59/02*** | (2006.01) |
| ***B65B 41/18*** | (2006.01) |
| *B65B 11/00* | (2006.01) |

(52) U.S. Cl.
CPC ..... *B65B 41/14* (2013.01); *B65B 41/18* (2013.01); *B65B 59/02* (2013.01); *B65B 2011/002* (2013.01); *B65B 2210/18* (2013.01)

(58) Field of Classification Search
CPC B65B 41/18; B65B 2011/002; B65B 2210/18
USPC ..... 53/588, 210, 218
See application file for complete search history.

(56) References Cited

U.S. PATENT DOCUMENTS

| | | | | |
|---|---|---|---|---|
| 4,098,052 | A | 7/1978 | Singer | |
| 4,317,322 | A * | 3/1982 | Lancaster et al. | B65B 11/008 53/399 |
| 4,499,709 | A * | 2/1985 | Miyano et al. | B65B 27/08 156/212 |
| 4,989,397 | A * | 2/1991 | Tomac et al. | B65B 13/32 100/7 |
| 5,182,894 | A * | 2/1993 | Bate | B65B 11/008 53/399 |
| 6,751,931 | B2 * | 6/2004 | Cere' | B65B 21/245 53/397 |
| 6,922,980 | B2 * | 8/2005 | Cere' | B65B 21/245 53/441 |
| 7,117,658 | B2 * | 10/2006 | Malini | B65B 21/245 53/588 |
| 7,140,166 | B2 * | 11/2006 | Cere' | B65B 21/245 53/449 |
| 9,284,105 | B2 * | 3/2016 | Ghezzi | B65B 11/025 |
| 2003/0024213 | A1 | 2/2003 | Cere' | |
| 2004/0118086 | A1 | 6/2004 | Cere | |
| 2007/0220840 | A1 * | 9/2007 | Pecchenini | B65B 11/008 53/588 |
| 2011/0000169 | A1 * | 1/2011 | Magri | B65B 21/245 53/450 |
| 2012/0102881 | A1 | 5/2012 | Moore et al. | |
| 2012/0151879 | A1 | 6/2012 | Ghezzi | |
| 2016/0200470 | A1 | 7/2016 | Zoboli | |

FOREIGN PATENT DOCUMENTS

| | | | | |
|---|---|---|---|---|
| EP | 1 288 127 | | 3/2003 | |
| EP | 1 431 185 | | 6/2004 | |
| WO | WO-2004058569 | A2 * | 7/2004 | B65B 21/245 |
| WO | 2011/024050 | | 3/2011 | |
| WO | 2015/028894 | | 3/2015 | |

OTHER PUBLICATIONS

Written Opinion of the International Searching Authority dated Dec. 7, 2016 in International (PCT) Application No. PCT/IB2016/053118.

* cited by examiner

Fig. 30
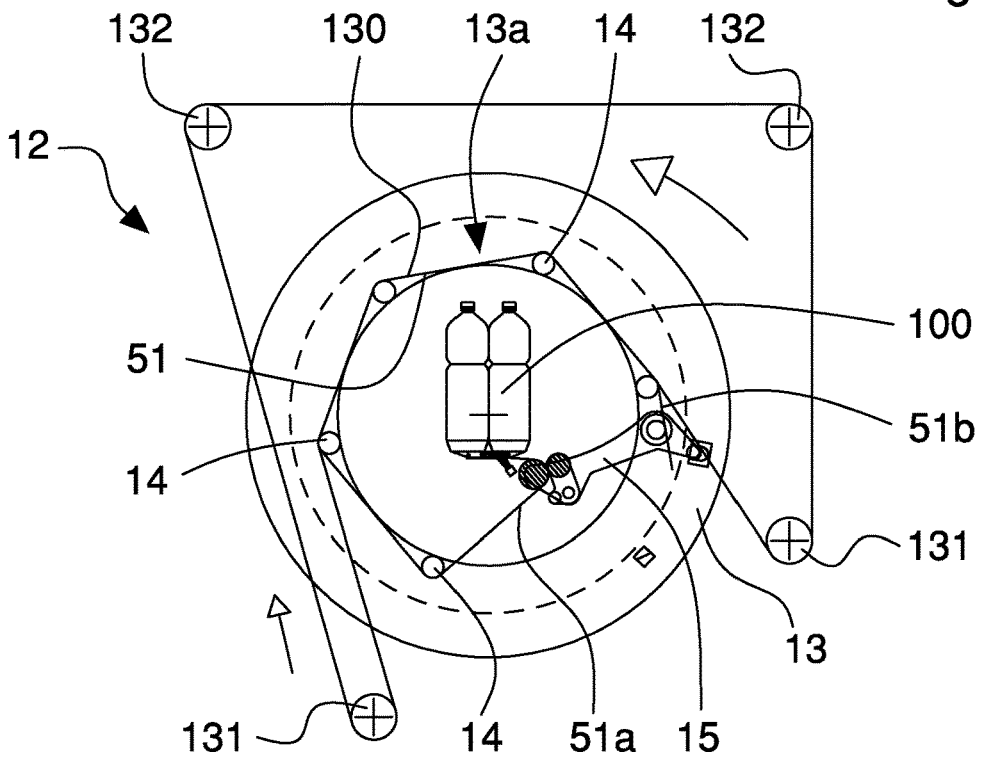
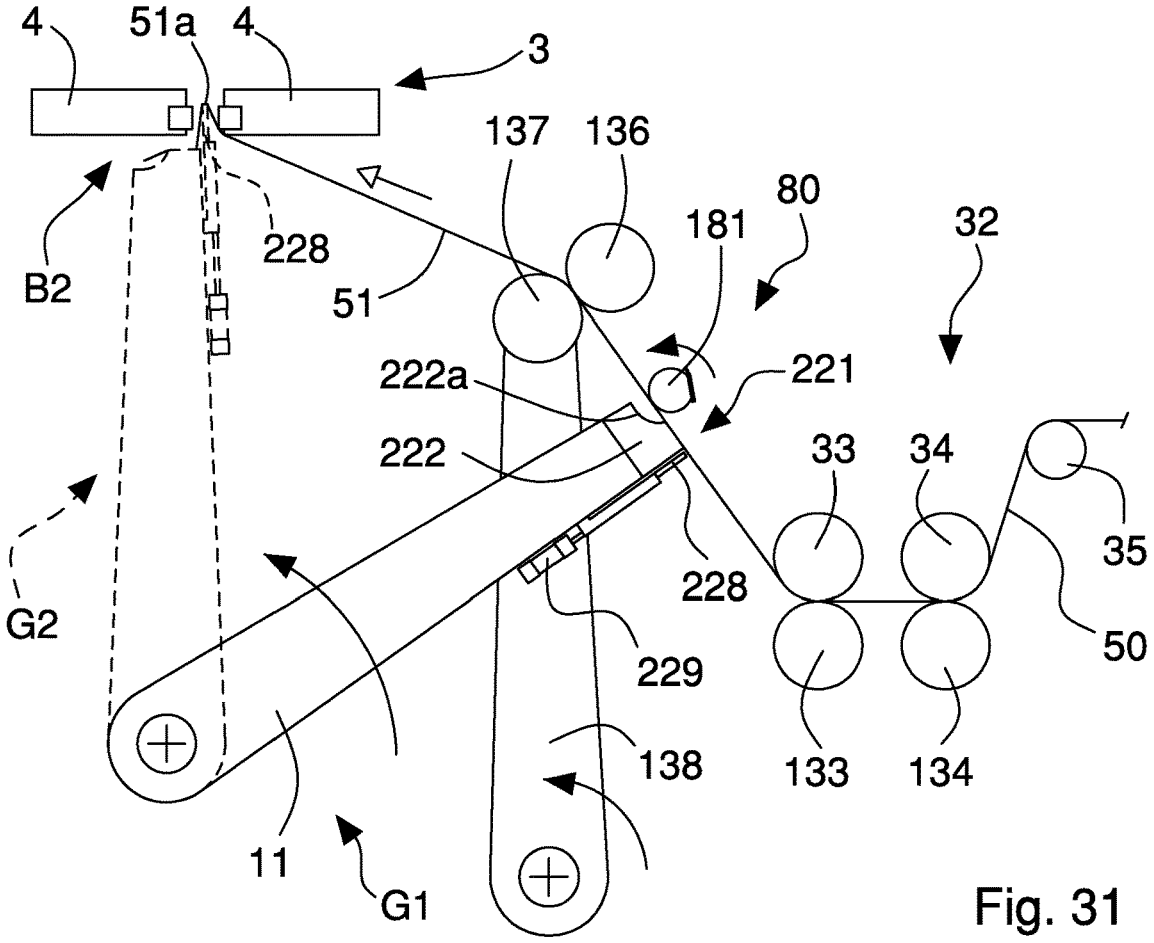
Fig. 31

WRAPPING MACHINE

BACKGROUND

Field

The invention concerns wrapping machines for wrapping products with a plastic film, in particular it refers to a wrapping machine arranged for wrapping groups of products in bundles by means of an extensible plastic film.

Description of the Related Art

Wrapping machines are known, the so-called shrink-wrapping machines, which allow wrapping groups of products having different shapes and sizes, such as bottles, cans, jars, tins, etc. with a film made of heat-shrink plastic material, that is a material capable to shrink when heated, in order to wrap, compact and block the products and therefore to form a bundle or envelope.

The known shrink-wrapping machines typically include a conveyance system that moves the products to be packed in succession through a series of operative stations. Downstream of a composition station, in which the products are divided and separated in groups of desired composition (for example according to two or more side by side rows of two or more products each), a wrapping station is provided in which the groups of products are successively and individually wrapped with a portion of plastic film having a suitable length, cut from a film reel, so as to form respective bundles or packages. In particular, the film is wrapped around the products in order to form a ring or tube, with two opposite transversal flaps of the film portion that are overlapped and fixed to each other, typically at the base of the products. Since the film is wrapped without exerting any tensile force, the products (being particularly unstable in case of bottles) do not have to be restrained and supported on the sides.

In a following heating station (shrinking tunnel or oven), the film portion that is wrapped in a ring shape around the products shrinks due to the heat effect in order to tightly wrap and compact the products and to make the bundle or final package, that leaves the group of the products open on the sides. The film by shrinking exerts a wrapping force that does not destabilize the products.

Since the film portion is positioned around the group of products with a precision, the heat-shrink plastic film can be printed with writings, drawings, decorations or the like, which in the bundle are placed in the desired positions, as currently required by the market, in particular in the beverages sector (bottles, cans).

A drawback of the known shrink-wrapping machines that work with heat-shrink plastic film is the high operating costs due to the cost of the plastic film (typically polyethylene, PTFE, PVDF, high density PVC and with a suitable thickness between 100 and 200 μm) and the energy consumption of the shrinking oven, in which the air hitting the film must be heated to a temperature between 170° and 200° C.

Another drawback of the known shrink-wrapping machines is that they do not allow packaging products that cannot undergo a heating up to the temperatures reached in the shrinking ovens.

In order to overcome such drawbacks and make the packaging of products more cost-effective, various solutions have been developed which provide using a cold extensible plastic film, i.e. without using shrinking ovens. In fact, the extensible film is a low-density plastic film usable with a thickness between 10 and 25 μm and stretchable by a percentage between 250 and 400% of its original length, therefore more convenient and cost-effective than a heat-shrinking film.

DE 3910823 discloses an apparatus for wrapping with an extensible film a group of bottles or bottle-shaped containers, comprising a conveyor that moves the bottles to a wrapping station. The wrapping station is provided with fixed guiding rods, which abut necks and recesses made on the bottom of the bottles, therefore vertically and laterally supporting the bottles, and with wrapping means comprising a ring structure rotating around a horizontal axis and supporting a film reel. During the rotation of the ring, the film wraps the group of bottles and the guiding rods. Then, the wrapped group of bottles is pushed outside the wrapping station, the guiding rods disengaging the film, by a following group of bottles to be wrapped that is moved by the conveyor.

A drawback of the above-disclosed wrapping apparatus is that it does not allow wrapping types of containers other than bottles with a neck and however it requires the substitution of the guiding rods based on shape and dimension of the bottles.

EP 1288127 of the same applicant discloses an apparatus for wrapping groups of products with a cold extensible film, comprising a plane along which the products are moved to form groups and a first wrapping station provided with means for unwinding an extensible film and preforming a first film portion that is wrapped in a tubular shape around first preforming means that comprise a plurality of rods parallel to an advancing direction of the products. The rods of the first preforming means are movable between a fully closed position, in which the film is wrapped around the rods in order to form the first tubular portion, an open position, in which the rods extend and transversally stretch the film, extending the first tubular portion in order to allow the insertion of the group of products, and a final position in order to allow the exit of the group of products wrapped with the film. The wrapping means include a ring structure rotating around a horizontal axis and supporting a reel from which the film is unwound. A second wrapping station, substantially identical to the first wrapping station, is positioned downstream thereof in order to wrap the group of products with a second tubular film portion. Between the two wrapping stations, a rotary table is provided which supports and rotates by 90° the group of products exiting the first wrapping station.

WO 2011/024050 discloses an apparatus for wrapping in bundles groups of containers for liquids comprising a plurality of wrapping stations each of which provided with a gripping assembly formed by two U-shaped pliers, which are movable along a longitudinal direction in order to grab and vertically block a group of products, leaving free lower and upper portions thereof. The wrapping station includes film wrapping means, comprising a ring structure, rotating around a horizontal axis parallel to the longitudinal direction and supporting a reel from which the film is unwound that is wrapped around the products during the rotation of the ring structure. A cutting element, movable parallel to the longitudinal direction, is provided to cut the film and separate the film portion wrapped around the products from the portion coming from the reel.

A drawback of the above-disclosed known wrapping apparatuses is that they do not allow using printed films in the wrapping of the groups of products in bundles. In particular, the wrapping means of the above-mentioned apparatuses, which include rotating rings supporting film reels, do not allow positioning in a precise and reproducible way the film portions unwound and separated from the film reel and wrapped around the products.

Another drawback of the above-mentioned wrapping apparatuses is the short operating autonomy due to the small dimensions of the film reel, which is supported and rotated around the products by the rotating ring. Therefore, frequent stops of the machine and related interruptions of the production for more or less extended times are required for replacing the depleted film reels.

SUMMARY OF THE EMBODIMENTS

An object of the present invention is to improve the known wrapping machines arranged for wrapping groups of products in bundles, in particular the wrapping machines using a film made of extensible plastic material for packaging groups of products in bundles.

A further object is to achieve a flexible and versatile wrapping machine, which allows wrapping in bundles in a precise and efficient way groups of products having different sizes and dimensions, in particular without requiring complicated and difficult adjustment and/or setting operations.

Still another object is to supply a wrapping machine having a high operation autonomy, in particular allowing replacing the depleted film reels without the need to stop the production.

These and further objects are achieved by a wrapping machine according to one or more of the following claims.

BRIEF DESCRIPTION OF THE DRAWINGS

The invention could be better understood and carried out with reference to the attached drawings that show some exemplary and non-limitative embodiments, wherein:

FIG. 30 is a schematic side view of another variant of the wrapping machine of the invention that shows wrapping means of the products;

FIG. 31 is a partial side view of another further variant of the wrapping machine of the invention that shows unwinding means and cutting means of the supplying unit;

DETAILED DESCRIPTION

Figure 1:
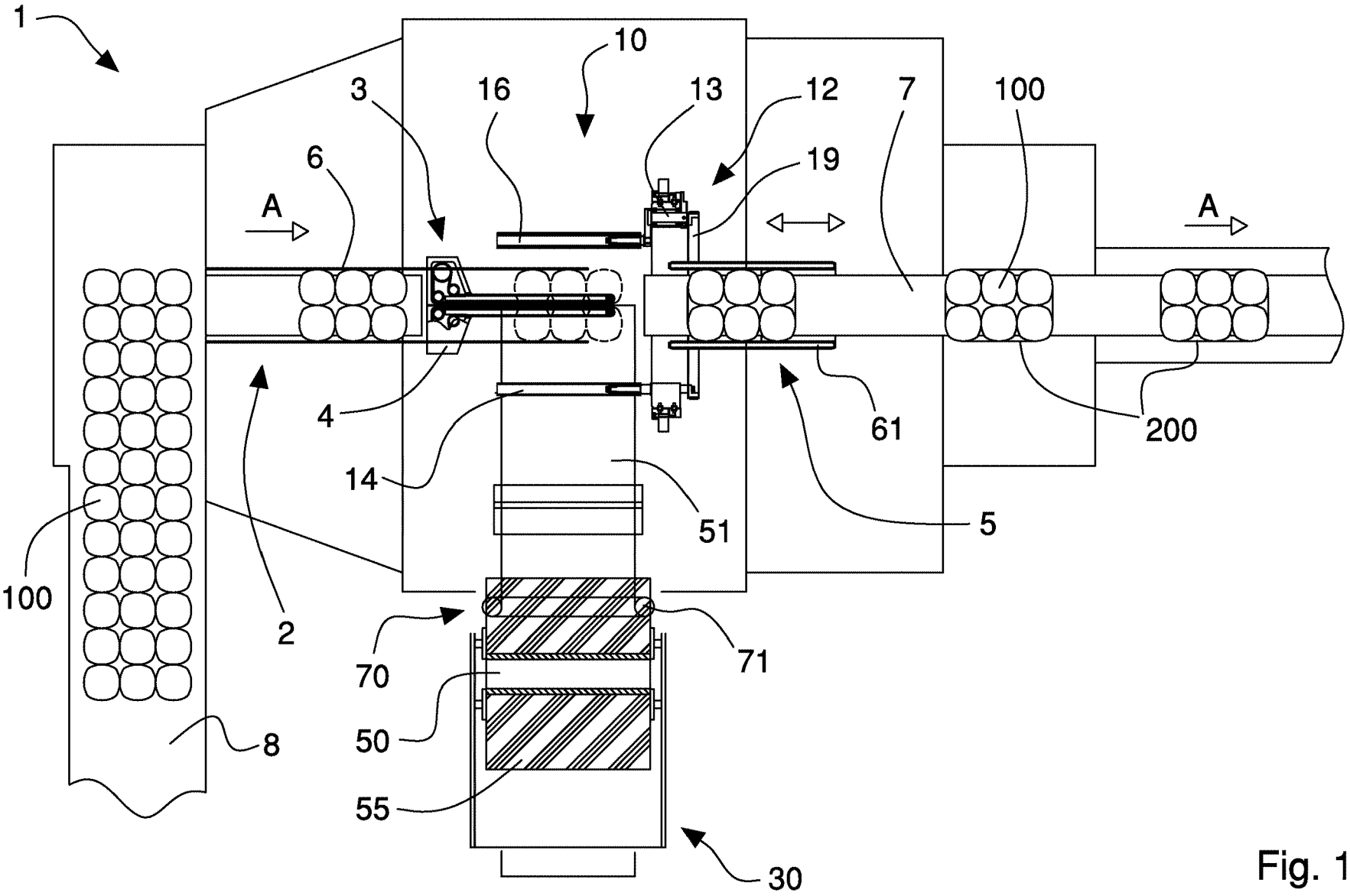
FIG. 1 is a schematic top plan view of the wrapping machine of the invention associated with groups of products to be wrapped and wrapped in bundles.
Figure 2:
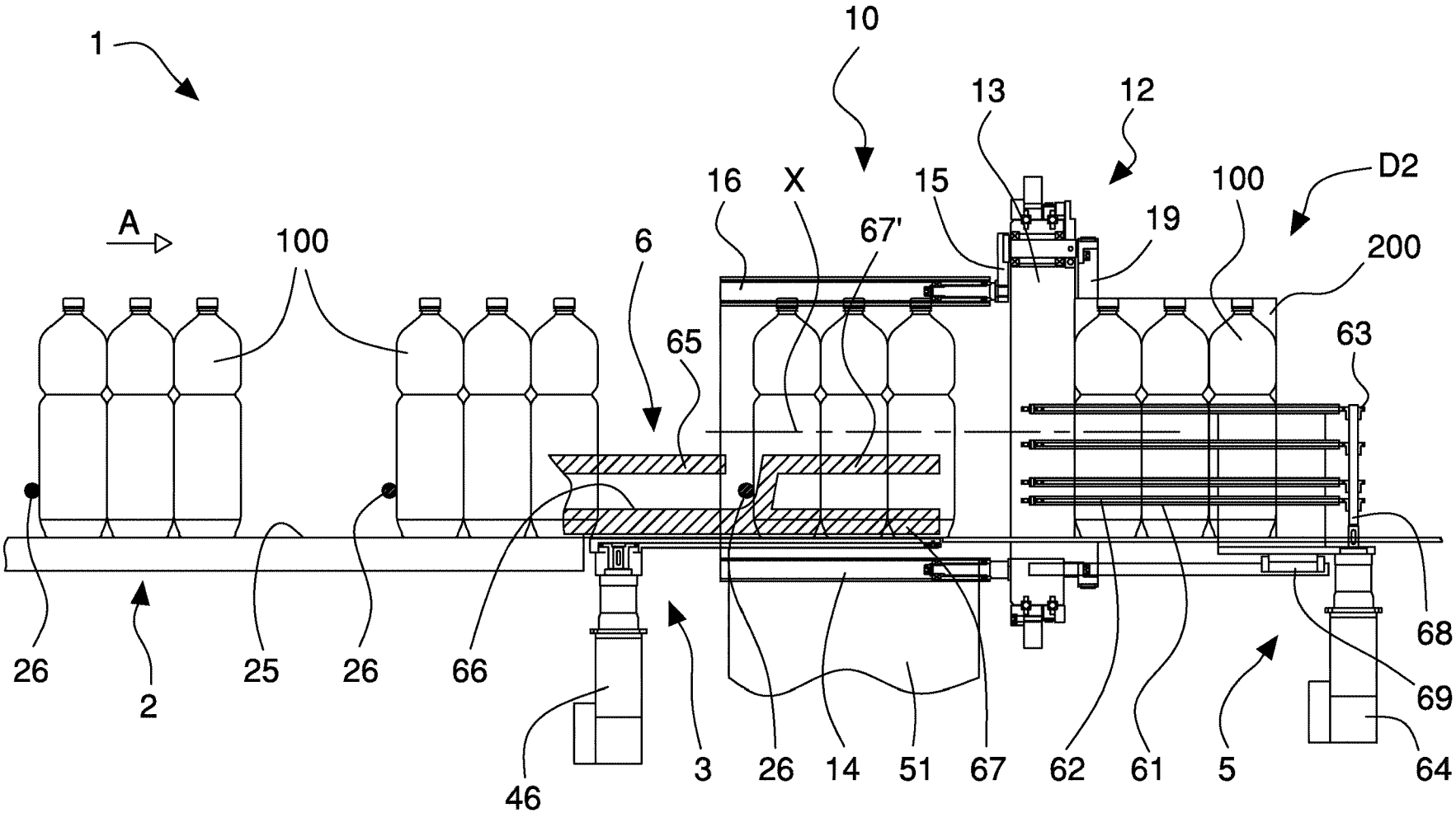
FIG. 2 is partial front view of the wrapping machine of FIG. 1 in an operating step.

With reference to the FIGS. 1 to 14, a wrapping machine 1 is shown that is arranged for wrapping groups of products 100 with a film 50 of extensible plastic material in order to form bundles 200.

The wrapping machine 1 includes first conveyor means 2 to support and move a group of products 100 entering along an advancing direction A, supporting means 3 to receive from the first conveyor means 2 and support the group of products 100 during the film wrapping, a wrapping unit 10 to wrap a film portion 51 having a preset length around the group of products 100 and the supporting means 3 in order to form a bundle 200, and a supplying unit 30 of the film 50 to supply to the wrapping unit 10 the film portion 51 having a preset length, separated from film 50 and unwound from a respective reel 55.

The length of the film portion 51 is calculated according to shape and/or dimensions of the group of products 100 to be wrapped and the desired number of film turns to be applied to the products.

The supporting means 3 comprise first gripping means 4 suitable to hold an initial flap 51*a* of the film portion 51 during the wrapping of the group of products 100, while the wrapping unit 10 includes an insertion arm 11, which is movable and arranged to grab the initial flap 51*a* exiting the supplying unit 30 and to transfer it to the supporting means 3, so as to be grabbed and blocked by the first gripping means 4, in an initial setting step of the wrapping. Moreover, the wrapping unit 10 includes wrapping means 12 for unwinding the film portion 51 from the supplying unit 30 and wrapping it around the group of products 100.

In the embodiment shown in the figures, the first conveyor means 2 receive the products 100, for example containers for liquids, such as bottles, small bottles, cans, jars or the same from feeding conveyor means 8 that are arranged transversally, in particular orthogonally, to the feeding direction A.

The first conveyor means 2 comprise a sliding plane 25, that is coplanar to a supporting plane M formed by the supporting means 3, and pushing means 26 movable and arranged for abutting and pushing the groups of products 100, which are spaced from each other along the advancing direction A. More precisely, the pushing means of a known type and not shown in details in the figures, comprise a plurality of pushing crossbeams 26 whose ends are mounted on respective endless moving chains, movable along an operative tract so as to abut and therefore push respective groups of products 100 along the advancing direction A from the feeding conveyor means 8 to the wrapping unit 10.

Second conveyor means 7 are provided downstream of the wrapping unit 10 in order to support and move the bundles 200 along the advancing direction A, exiting the wrapping machine 1. The second conveyor means 7 comprise, for example, a motorized belt or conveyor of known type and not shown in details in the figures.

Figure 10:
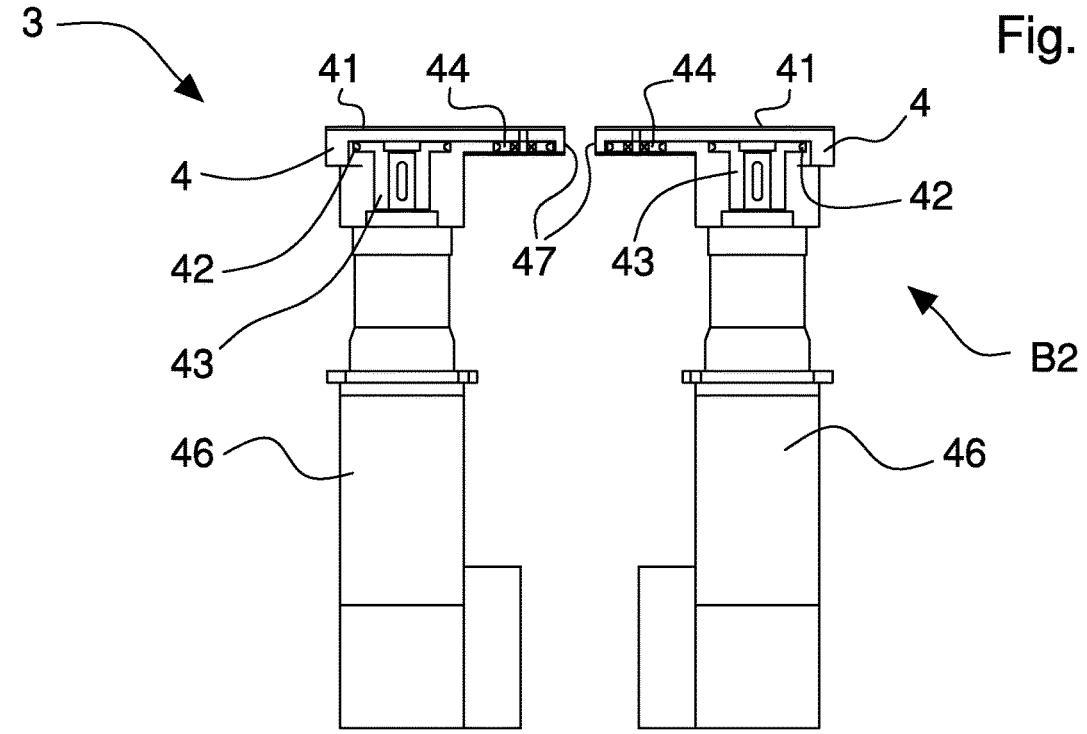
FIG. 10 is a side view of supporting means of the machine of FIG. 1 in an opening position.
Figure 11:
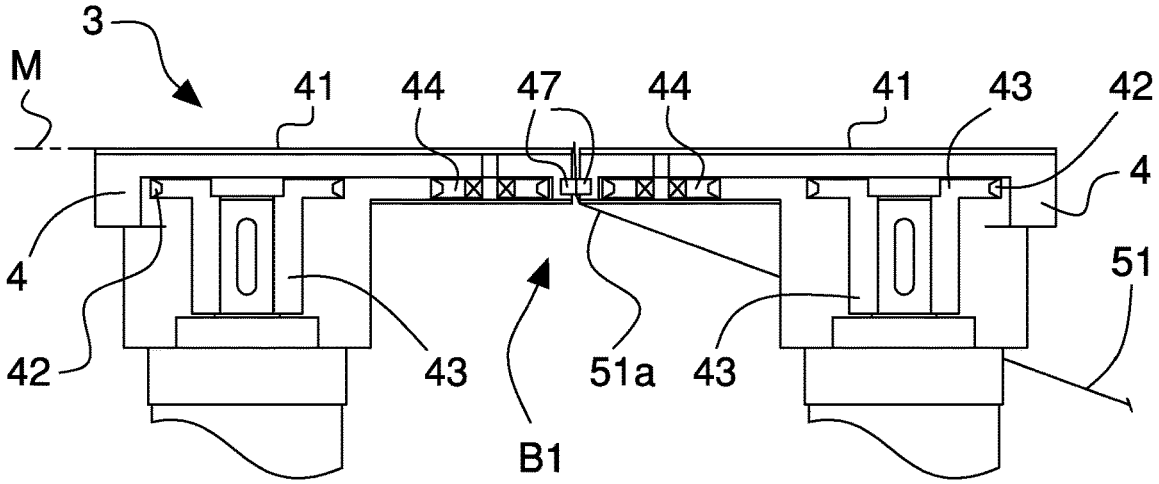
FIG. 11 is an enlarged and partial side view of the supporting means in a closing position for holding an initial flap of film.
Figure 12:
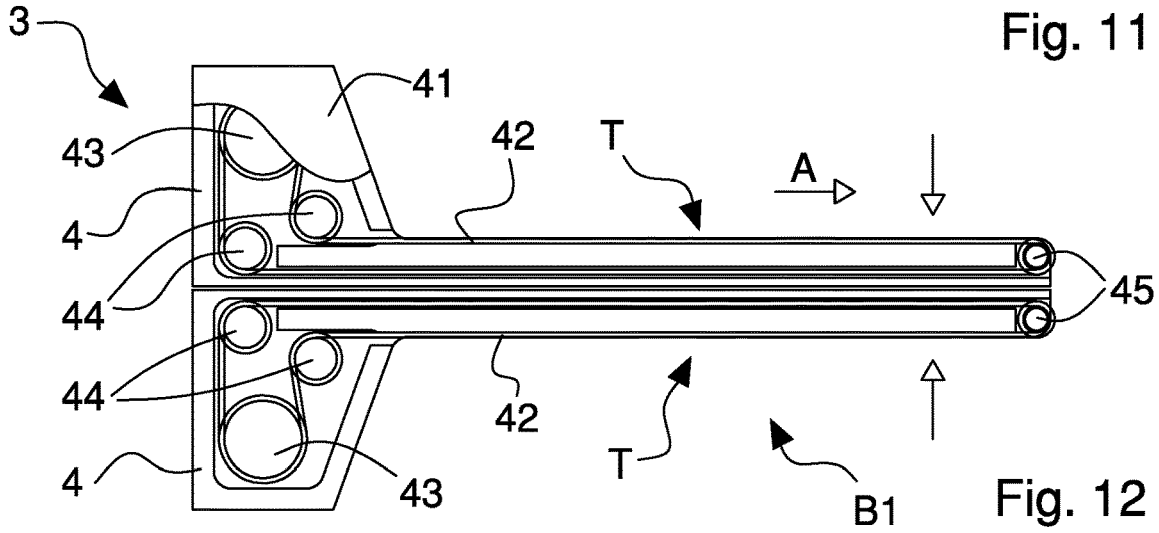
FIG. 12 is a top plan view of the supporting means in the closing position.

As shown in particular in FIGS. 10 to 12, in an embodiment of the wrapping machine of the invention, the first gripping means include two supporting elements 4 of the supporting means 3, said supporting elements 4 being adjacent and opposed, defining a supporting plane M for the group of products 100 and movable transversally to the advancing direction A between a closing position B1 and an opening position B2. In the closing position B1 the supporting elements 4 abut against each other in order to block an initial flap 51*a* of the film portion 51 during the wrapping; in the opening position B2, the supporting elements 4 are mutually spaced apart to allow the initial flap 51*a* of the film portion 51 to be inserted or released, as better explained in the following of the description. Each supporting element 4 includes an abutting portion 47 having an elongated shape (for example a strip made of elastic material) and arranged parallel to the advancing direction A. In the closing position B1 of the supporting means 3, the abutting portions 47 of the two supporting elements 4 are against each other so as to hold and block the initial flap 51*a* of the film portion 51 inserted and interposed therebetween (FIG. 10).

Each supporting element 4 further includes a substantially horizontal supporting wall 41, suitable to support the group of products 100 and forming the supporting plane M. Each supporting element 4 also includes a respective first moving belt 42, flexible, endless and arranged for being abutted by the film portion 51 along an operative tract T during the wrapping. The first belt 42 is driven in such a way to move, at the operative tract T, along the advancing direction A together with the bundle 200 exiting the wrapping unit 10 in order to allow the supporting elements 4 to disengage from the bundle 200. The first belt 42 is wrapped around a plurality of pulleys 43, 44, 45 that are rotatable around respective axes orthogonal to the supporting wall 41, i.e. to the supporting plane M. The first belt 42 has an abutting surface almost orthogonal to the supporting wall 41, which can be engaged in the operative tract T by the film portion 51 wrapped around the group of products 100.

In the operative tract T, the first belt 42 exits from the respective supporting element 4 in order to be abutted by the film portion 51.

Inside the respective supporting element 4, the first belt 42 is wrapped around a first pulley 43, rotatably driven by a respective first motor 46, a couple of second return pulleys 44 and a third return pulley 45, the return pulleys 44, 45 being rotatable and idle.

In a variant of the wrapping machine 1, not shown, the supporting elements 4 of the supporting means 3 (that act also as first gripping means of the initial flap 51*a* of the portion 51) do not include movable belts abutting the flexible and foldable material. In this case, disengagement of the wrapped products 100 from the supporting means 3 occurs thanks to size and shape of the supporting elements 4 that facilitate the sliding of the material, i.e. the portion 51 of film 50.

The wrapping machine 1 of the invention also comprises guiding means 5 for abutting the sidewalls of the bundle 200 and guiding the latter exiting the wrapping unit 10 and disengaging from the supporting means 3.

The guiding means 5 are movable along the advancing direction A between a seizing position D1, wherein they abut the bundle 200 inside the wrapping unit 10, and a releasing position D2, in which said guiding means 5 are spaced from the wrapping unit 10 and give the bundle 200 to the second conveyor means 7.

The guiding means 5 comprise one or more couple of abutting rods 61, for example four couples, the abutting rods 61 of each couple being parallel to each other and to the advancing direction A and opposed, spaced apart by a distance equal to the width or transversal dimension of the bundle 200 in order to abut sidewalls thereof.

The couple of abutting rods 61 are vertically spaced from each other in order to abut and vertically support products 100 having different dimension and size. The abutting rods 61 are supported by a couple of uprights 68 that are substantially vertical and fixed to a supporting carriage 69 movable linearly along the advancing direction A, in both the directions, between the seizing position D1 and the releasing position D2. The abutting rods 61 are fixed in an adjustable way along the uprights 69, according to shape and dimensions of products 100.

The abutting rods 61 are provided with respective second moving belts 62 that are endless, arranged to abut opposite sidewalls of the bundle 200 and rotated in order to move the said bundle 200 along the advancing direction A exiting the wrapping unit 10. More precisely, and as better explained in the following of the description, the guiding means 5 cooperate in the transfer of bundle 200 from the wrapping unit 10 to the second conveyor means 7.

Figure 6:
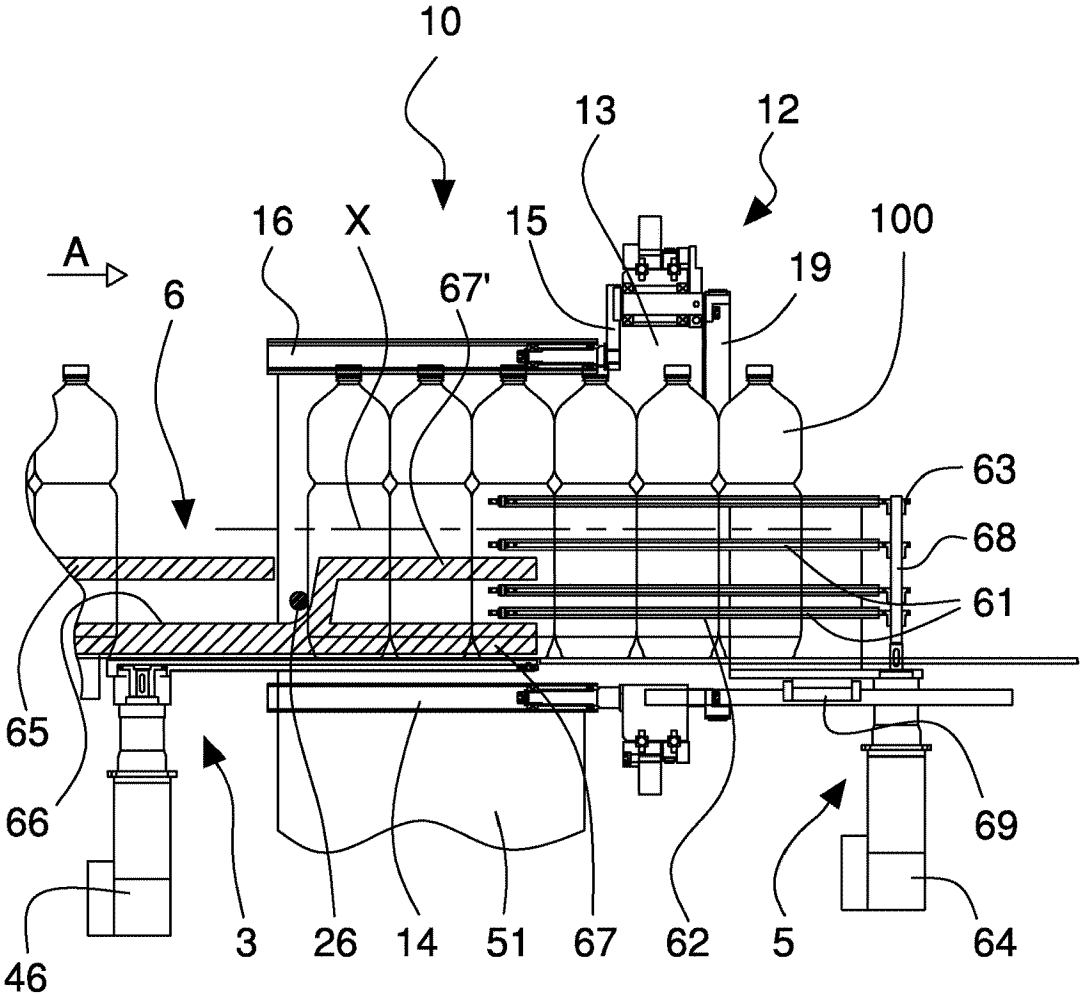
Figure 7:
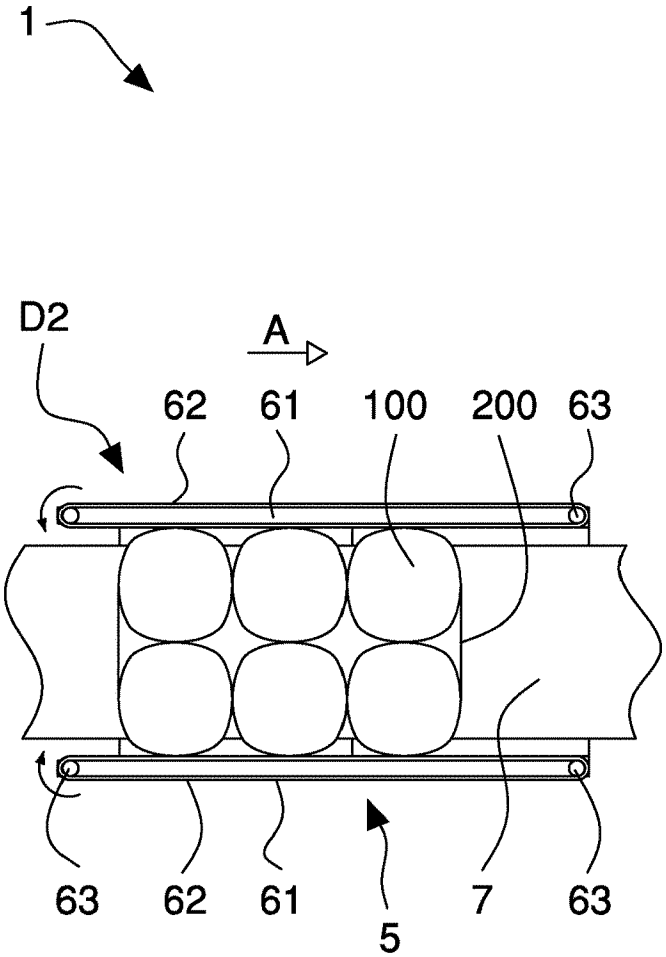
FIG. 7 is an enlarged and partial plan view of FIG. 1 showing guiding means in a release position.
Figure 9:
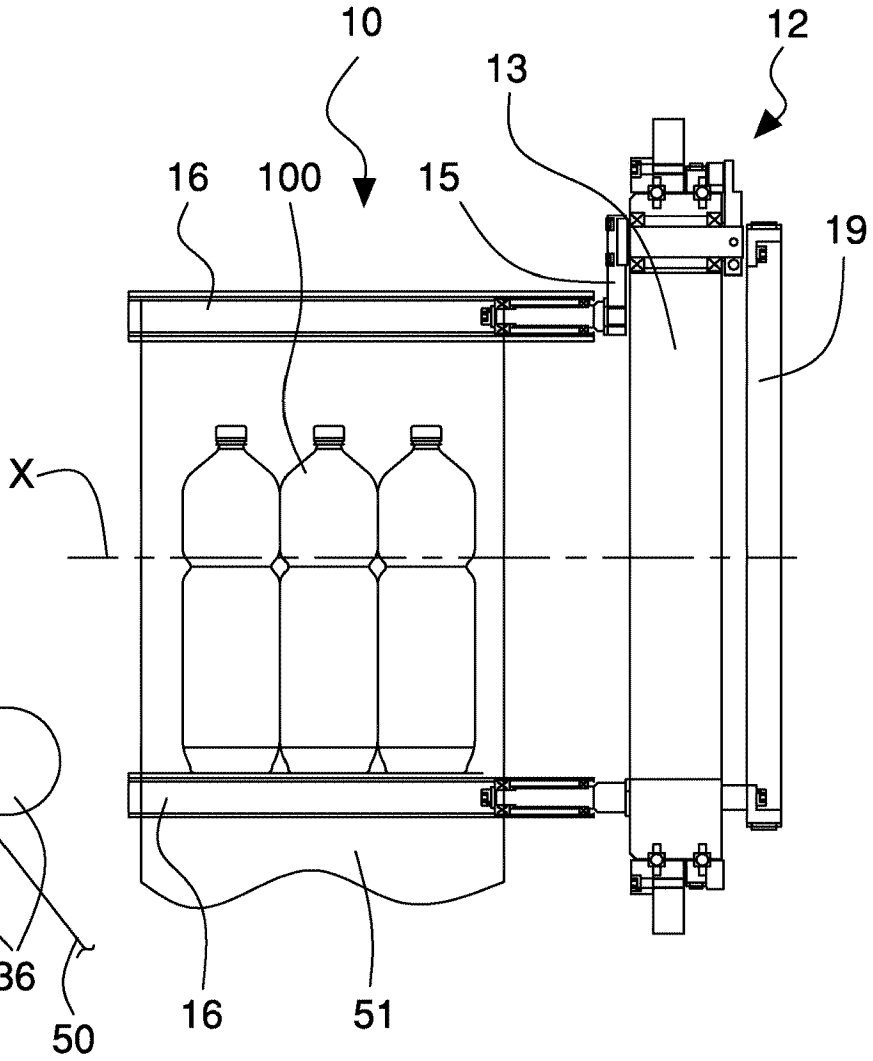
FIG. 9 is a section front view of the wrapping unit of FIG. 7.

With particular reference to FIG. 6, the second belt 62 of each abutting rod 61, having for example a flat shape, is wrapped around a couple of respective pulleys 63 rotating around respective axes that are orthogonal to the supporting plane M. At least one of the pulleys is rotated by a second motor 64 fixed to the supporting carriage 69. The second belt 62 has a respective abutting surface that is substantially orthogonal to the supporting plane M and engages a sidewall of the bundle 200. In the shown embodiment, the second belts 62 of the abutting rods 61 that abut the same sidewall of the bundle 200 (i.e. the abutting rods 61 aligned and vertically superimposed at the same side of the bundle 200, fixed to the same upright 68) are driven by the same second motor 64, for example an electrical rotating motor.

Containment means 6 are provided to abut and laterally guide the group of products 100 from the first conveyor means 2 along the advancing direction A and in particular inside the wrapping unit 10.

The containment means 6 comprise a couple of lateral panels 65, fixed to frame means of the wrapping machine 1, having an elongated shape and arranged parallel and opposed so as to abut the group of products 100 at opposite sides thereof.

In the shown embodiment, each lateral panel 65 has a through opening 66 for allowing the pushing crossbeams 26 passing through and moving and a couple of guiding protrusions 67, 67' having a flat and elongated shape, arranged for laterally supporting during the wrapping the products 100 to be wrapped by the film portion 51. The flat and elongated shape of the lateral panels 65 allows the latter ones to easily disengage from the bundle 200 at the end of wrapping when said bundle is pushed out of the wrapping unit 10 by an incoming group of products 100 to be wrapped, in cooperation with the guiding means 5 (thanks to the second belts 62).

Figure 3:
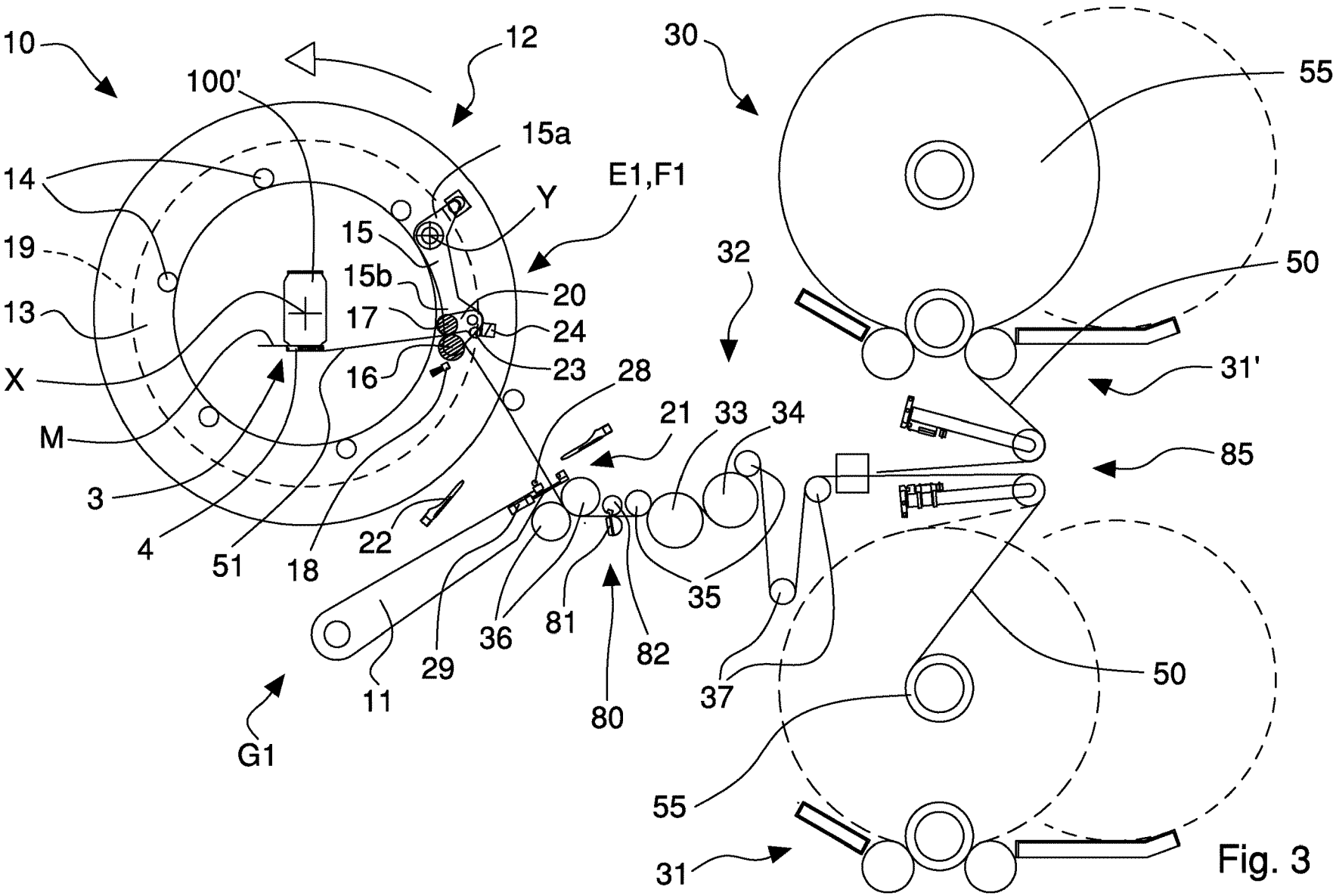
FIG. 3 is a schematic side view of the machine of FIG. 1 wherein some parts have been removed in order to better show a wrapping unit and a supplying unit of a wrapping film.
Figure 5:
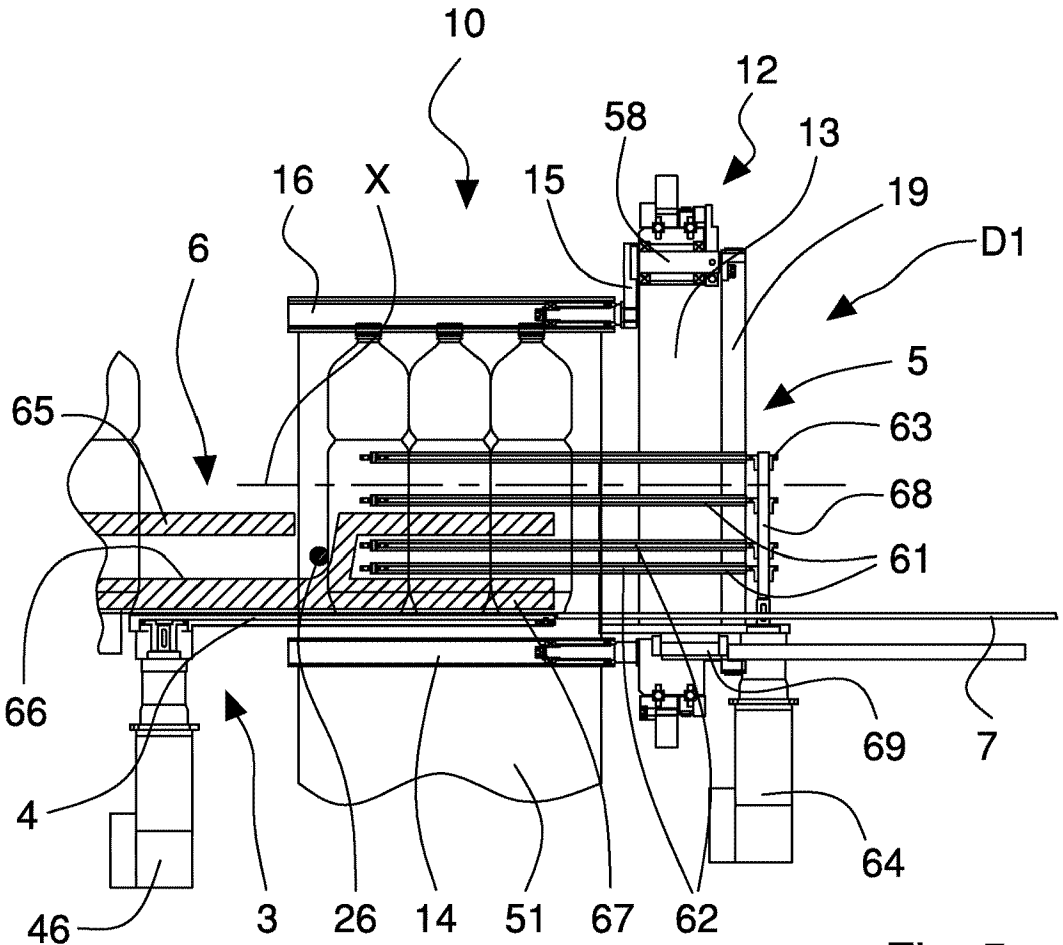
FIGS. 5 and 6 are front partial views of the wrapping machine of FIG. 1 in two further respective operating steps.

With particular reference to FIG. 3, the wrapping unit 10 comprises an insertion arm 11, movable and arranged to grab the initial flap 51*a* exiting the supplying unit 30 and to transfer it to the supporting means 3 in order to be grabbed and blocked by the latter, in an initial setting step of the wrapping machine before the wrapping. The wrapping unit 10 also comprises wrapping means 12 for unwinding and drawing the film portion 51 from the supplying unit 30 and wrapping it around the group of products 100 and the supporting means 3.

The wrapping means 12 of the wrapping unit 10 comprise a supporting ring 13 rotating around a wrapping axis X, parallel to the advancing direction A, a plurality of wrapping rollers 14 mounted in a cantilever way on the supporting ring 13 and an unwinding arm 15.

The wrapping rollers 14 are mounted angularly spaced on the supporting ring 13 and rotating around respective longitudinal axes, parallel to the wrapping axis X, and they extend from the supporting ring 13 in the advancing direction A.

The unwinding arm 15 has a first end 15*a*, rotatably fixed to the supporting ring 13 around a respective rotation axis Y, and a second end 15*b* that supports one or more unwinding rollers 16, 17, rotating around the respective longitudinal axes and arranged to abut and guide the film portion 51 towards the products 100 during their wrapping, the unwinding arm 15 being movable in order to bring near and/or move away the unwinding roll(s) 16, 17 to/from said products 100 during the wrapping.

In the shown embodiment, the second end 15*b* of the unwinding arm 15 is provided with a couple of unwinding rollers 16, 17 arranged to abut opposite sides of the film portion 51 when the initial flap 51*a* of the film portion 51 is grabbed and held by the first gripping means 4 of the supporting means 3 in the closing position B1.

The supporting ring 13 is rotatably supported by frame means of the machine (not shown) and is rotated by respective actuating means, comprising for example a rotating electric motor.

As better explained in the following of the description, when the supporting ring 13 rotates around the wrapping axis X in a first wrapping step, it unwinds and draws the film portion 51 from the supplying unit 30 and at the same time, by means of the unwinding arm 15, it wraps a first tract of the film portion 51, provided with the initial flap 51*a*, around the group of products 100 and wraps a second tract of the film portion 51, provided with a terminal flap 51*b*, around the wrapping rollers 14. In a second wrapping step, the supporting ring 13 rotates and wraps, by means of the unwinding arm 15, the second tract of the film portion 51, drawn and unwound by the wrapping rollers 14, around the group of products 100 in order to complete and form the bundle 200.

Figure 8:
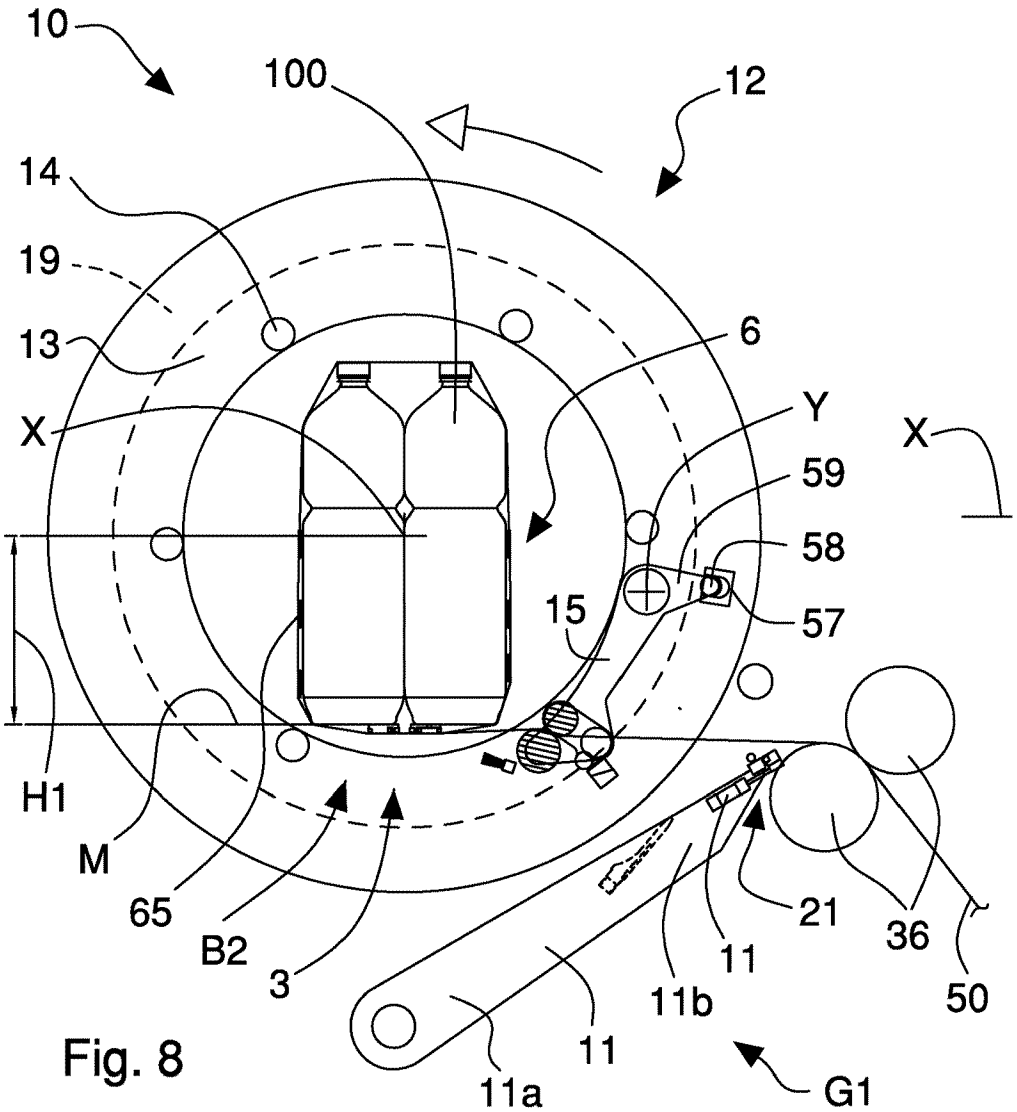
FIG. 8 is a schematic and partial side view of the wrapping unit.
Figure 14:
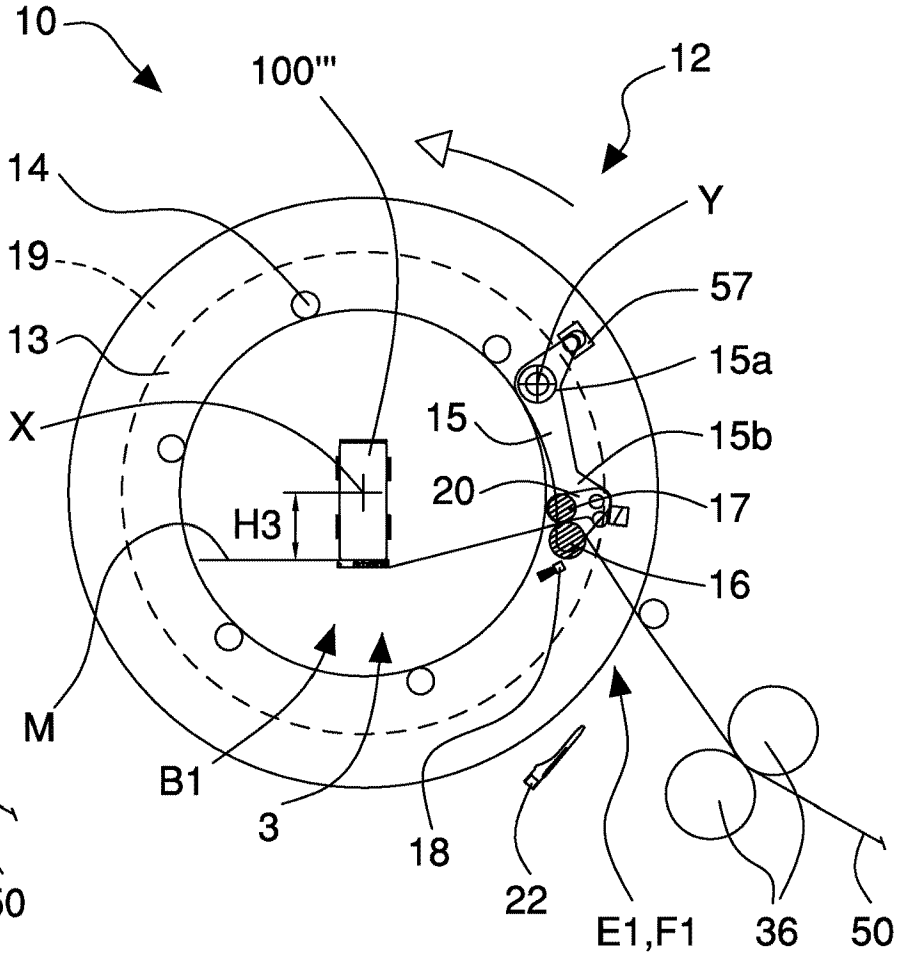
FIGS. 13 and 14 are views like the one of FIG. 8 which show the wrapping unit in two respective different working positions with respective different products to be wrapped.
Figure 13:
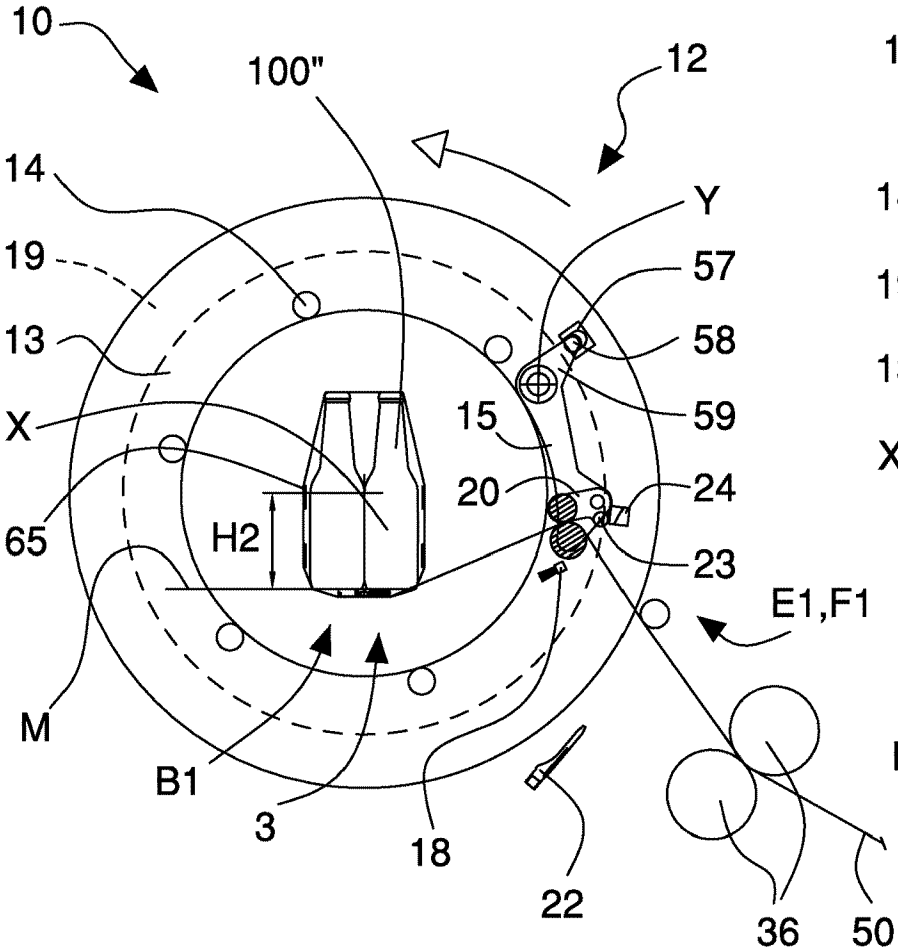

As shown in FIGS. 8, 13 and 14, the wrapping means 12 can be arranged along a direction orthogonal to the supporting plane M in different working positions according to the dimensions of the products 100 to be wrapped and so that the latter one are substantially centered with respect to the wrapping axis X in order to allow an optimal wrapping with the film portion 51.

In the case of products having big dimensions, for example water bottles 100 (FIG. 8), the wrapping means 12 are positioned in such a way that the rotation axis X is at a first distance H1 from the supporting plane M formed by the supporting means 3 and the sliding plane 25. The first distance H1 is longer than a second positioning distance H2 of the rotation axis X of the wrapping means 12 with products 100" of an intermediate size (FIG. 13). In turn, the second distance H2 is longer than a third positioning distance H3 of the wrapping axis X of the wrapping means 12 with containers 100''' of a small size (FIG. 14).

Each wrapping roller 14 includes a respective cylindrical element having a length equal to or longer than the width of the film 50 and fixed to the supporting ring 13 in order to freely rotate around the respective longitudinal axis, parallel to the wrapping axis X.

Likewise, the unwinding rollers 16, 17 comprise respective cylindrical elements having a length equal to or longer than the width of the film 50. At least the first unwinding roller 16 is externally coated with a layer of elastomeric or similar material in order to abut with friction and therefore hold the film portion 51 during the wrapping around the group of products 100 thus guaranteeing an appropriate wrapping tension. The first unwinding roller 16 is also provided with an internal clutch in order to offer an adjustable resistance to the rotation, which allows maintaining the film under tension or traction during the wrapping around the group of products.

The unwinding arm 15 is movable between a first operative position E1, in which the unwinding rollers 16, 17 are more spaced from the group of products 100 to deflect the film portion 51 towards the group, in particular in the first wrapping step, and a second operative position E2, in which the unwinding rollers 16, 17 are closer to the group of products 100 to deflect on the products at least the terminal flap 51*b* of the film portion 51. For this purpose, the unwinding arm 15 includes brush means 18 fixed to the second end 15*b* and arranged to abut and stick the film portion 51, in particular the terminal flap 51*b*, to the group of products 100 at the end of the wrapping.

The wrapping means 12 further include a driving ring 19 that is adjacent and coaxial to the supporting ring 13 and is rotatably drivable around the wrapping axis X separately and independently from the supporting ring 13. The driving ring 19 is rotatably supported by the frame means of the machine and is rotated by respective actuating means comprising, for example, a rotating electric motor. The driving ring 19 is connected to the first end 15*a* of the unwinding arm 15 in order to rotate the latter at least between the first operative position E1 and the second operative position E2. More precisely, the driving ring 19 has a seat 57 arranged to receive a first guiding pin 58 fixed to a moving portion 59 of the unwinding arm 15 that extends from the second end 15*b*. Alternatively, the driving ring 19 can include a cam profile suitable to abut and move the guiding pin 58.

As better explained in the following of the description, the relative rotation of the driving ring 19 with respect to the supporting ring 13 causes the rotation of the unwinding arm 15 around the respective rotation axis Y between the first operative position E1 and the second operative position E2.

The unwinding arm 15 comprises a first unwinding roller 16 rotatably mounted around a respective rotation axis on the second end 15*b* and a second unwinding roller 17 rotatably mounted around a respective rotation axis on the second end 15*b* and movable between an abutting position F1, wherein it abuts the first unwinding roller 16 to engage and drag the film portion 51, and a disengagement position F2, wherein the second unwinding roller 17 is spaced from the first unwinding roller 16 to allow, in the initial setting step, the insertion arm 11 transferring the initial flap 51*a* to the supporting means 3 and the first roller 16 being engaged by the film portion 51. In particular, the unwinding arm 15 is provided with a driving lever 20 rotatably fixed to the first end 15*a* of said unwinding arm 15 and rotatably supporting the second unwinding roller 17. The driving lever 20 is operated by the driving ring 19 in order to move the second unwinding roller 17 between the abutting position F1 and the disengagement position F2. More precisely, the driving lever 20 has a second guiding pin 23 that is abutted (in the first operative position E1 of the unwinding arm 15) by a driving element 24 of the driving ring 19. The driving element 24 has an abutting wall that is in contact with the second guiding pin 23; in that way, a relative rotation of the driving ring 19 with respect to the supporting ring 13 causes the sliding of the second guiding pin 23 on the abutting wall and thus the partial rotation of the driving lever 20.

The insertion arm 11 includes a first terminal portion 11*a* rotatably fixed to the frame means of the machine 1 and a second terminal portion 11*b* provided with second gripping means 21 fit for grabbing and holding the initial flap 51*a* of the film portion 51.

The insertion arm 11 is rotatably drivable between a gripping position G1, in which it is adjacent to said supplying unit 30, in particular in order to grab the initial flap 51*a*, and a transferring position G2, in which the second gripping means 21 of the insertion arm 11 are adjacent and facing the first gripping means 4 of the supporting means 3 in order to transfer the initial flap 51*a* to said first gripping means 4. For this purpose, the transferring arm 11 includes an insertion bar 28 positioned at the second gripping means 21 and movable along the insertion arm 11 in order to insert the initial flap 51*a* between the two supporting elements 4 positioned in the opening position B2. The initial flap 51*a* is kept inside the supporting elements 4 until they move in the closing position B1 by an air blow emitted by the insertion bar 28.

The insertion bar 28 is linearly moved by a respective linear actuator, for example a pneumatic cylinder, of a known type and not shown in the figures.

In the embodiment shown in the figures, second gripping means include pliers 21 provided with a fixed member 21*a* and a movable member 21*b*, the latter moved by a respective linear actuator 29, for example a pneumatic cylinder, between a position abutting the fixed member 21*a* to grab and block the initial flap 51*a* of the film portion 51 and a position spaced from said fixed member 21*a* to allow the release of the initial flap 51*a* and/or the passage of the film 50.

Figure 24:
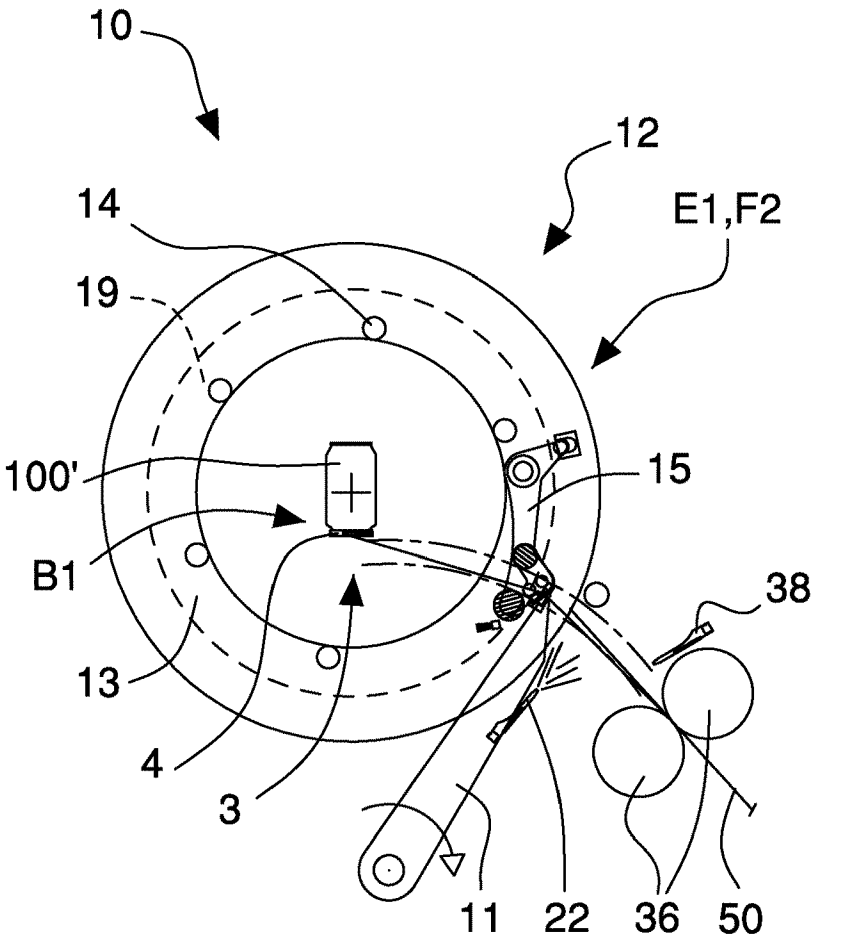
Figure 23:
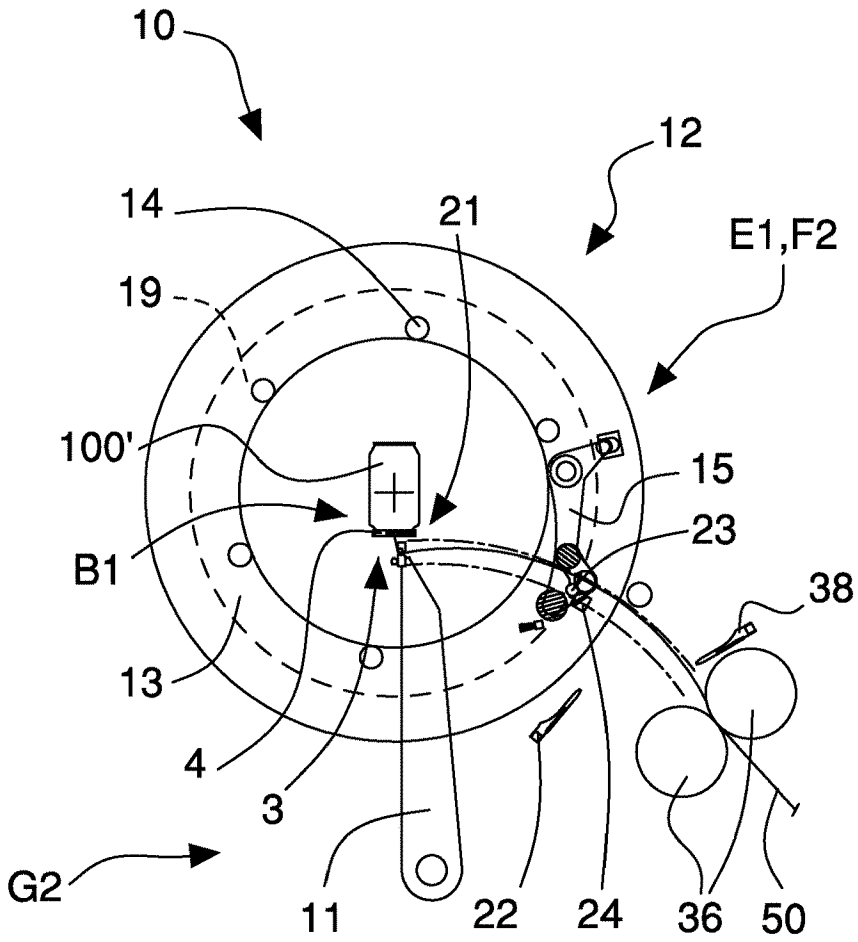

First blowing means 22 fixed to a frame of the wrapping machine 1 are provided in order to emit a compressed air jet capable to move away the film 50 from the pliers 21 during the return movement of the insertion arm 11 from the transferring position G2 to the gripping position G1 (FIG. 24).

With particular reference to FIG. 3, the supplying unit 30 comprise supporting and moving means 31, 31' to support and rotate at least one reel 55 of film 50, unwinding means 32 to unwind and pre-stretch said film 50 unwound from the reel 55 and cutting means 80 to make a separation line on said film 50 that is transversal to an unwinding direction of film and arranged to separate the film portion 51, exited from the unwinding means 32, from the film 50 unwound from the reel 55.

The unwinding means 32 comprise in particular a couple of motorized pre-stretching rollers 33, 34, suitable to unwind and pre-stretch the film 50, first return rollers 35 for deflecting the film 50 towards the pre-stretching rollers 33, 34 and a couple of motorized pulling rollers 36 arranged to dispense the film portion 51 to the wrapping unit 10 and to maintain tight the tract of film comprised between said pulling rollers and the pre-stretching rollers 33, 34.

The pre-stretching rollers include a first fast roller 33 positioned downstream of a second slow roller 34 in such a way to stretch or elongate the film 50 by a preset percentage (depending on the rotation speed difference between the two rollers). The pre-stretching rollers 33, 34 are rotated by at least one motor. Second return rollers 37 are provided upstream of the pre-stretching rollers and form dancing means for controlling tension and supply of film 50 during the wrapping. Alternatively, the film tension can be adjusted and controlled by means of load cells associated to the return rollers or by measuring the operative parameters of the motors that drive the pre-stretching rollers 33, 34 and the pulling rollers 36.

The cutting means 80 are arranged between the two pulling rollers 36 and a return roller 35, downstream of the pre-stretching rollers 33, 34 to execute a plurality of cuts on the film 50, in particular a plurality of perforations that form a separation line.

For this purpose, the cutting means 80 comprise a cutting roller 81 rotating around a respective longitudinal axis and provided with a plurality of cutting elements mutually spaced along said longitudinal axis and arranged to cut and perforate the film 50 in order to realize the transversal separation line, in particular orthogonal to a unwinding direction of the film 50. The cutting means 80 also comprise a rotating counter roller 82, provided with a longitudinal cavity arranged to receive the cutting elements of the cutting roller. The counter roller 82 rotates synchronous with the cutting roller 81, both rollers being rotated by the same motor.

Sensor means are provided to measure the length of the film portion 51 dispensed by the supplying unit 3. Such sensor means comprise, for example, an angular transducer or encoder that measures the number of turns of the pulling rollers 36.

As better explained in the following of the description, during the wrapping of the group of products 100, when the film portion 51 is completely exited from the supplying unit 30, in particular when the separation line has passed the pulling rollers 36, the latter ones and the pre-stretching rollers 33, 34 are stopped and the second gripping means 21 of insertion arm 11 are closed in order to block the film 50. In such a way, the film portion 51 drawn by the wrapping means 12, in particular by the rotation of the supporting ring 13, is separated along the separation line from the film 50 coming from the reel 55. Because of the traction, which the film 50 undergoes to, the plastic material weakened by the cuts made by the cutting means 80 is torn in a precise and clean way along a transversal line.

The film flap that is held by the pliers 21 forms the initial flap 51*a* of the subsequent film portion 51 intended to wrap a respective group of products 100.

Second blowing means 38 are provided downstream of the two pulling rollers 36 to blow the film flap generated from the breaking and held by the second gripping means 21 towards the insertion arm 11.

In the shown embodiment, the supporting and moving means include first supporting and moving means 31 and second supporting and moving means 31' that are arranged to support and rotate respective reels 55 of film 50 and joining means 85, of known type and not shown in details, for joining a head flap of a new reel 55 to a tail flap of an almost depleted reel 55. In this way, the substitution of the reels 55 can occur without requiring stopping the wrapping machine 1.

With particular reference to FIG. 1, the wrapping machine 1 of the invention includes narrowing means 70 of the film portion 51 coming out from the supplying unit 30. The narrowing means 70 comprise a couple of narrowing rollers 71 that are mounted parallel and opposed to each other, free to rotate around respective longitudinal axes, substantially orthogonal to the film portion 51. The narrowing rollers 71 abut and fold, in particular partially roll up, longitudinal opposed edges of the film portion 51, in order to confer a greater mechanical resistance to the film portion and the wrapping made around the group of products 100.

The transversal distance between the two narrowing rollers 71 can be adjusted by suitable actuating means according to the width of film 50 and/or the extent of the rolling up/folding to be executed on the longitudinal edges of the film portion 51.

The operation of the wrapping machine 1 of the invention provides advancing a group of products 100 to be packaged in a bundle 200 along the first conveyor means 2. The group of products 100 is pushed on the sliding plane 25 along the advancing direction A by the pushing crossbeams 26 and is laterally supported by the second guiding means 6. In proximity of the wrapping unit 10, the group of products 100 is transferred from the sliding plane 25 to the supporting means 3, in particular the products 100 are pushed on the supporting plane M formed by the supporting walls 41 of the supporting elements 4. The latter ones are positioned in the closing position B1 since they hold and block the initial flap 51*a* of the film portion 51 to be wrapped around the products 100.

Once the group of products 100 is arrived inside the wrapping unit 10 in the correct wrapping position, the wrapping means 12 can be activated in order to begin the film wrapping.

The position of the wrapping means 12 with respect to the supporting plane M (distance H1, H2, H3) is preventively adjusted according to the dimensions of products 100 (FIGS. 8, 13, 14). In particular, the supporting ring 13 and the driving ring 19 are vertically moved, orthogonally with respect to the supporting plane M.

Figure 16:
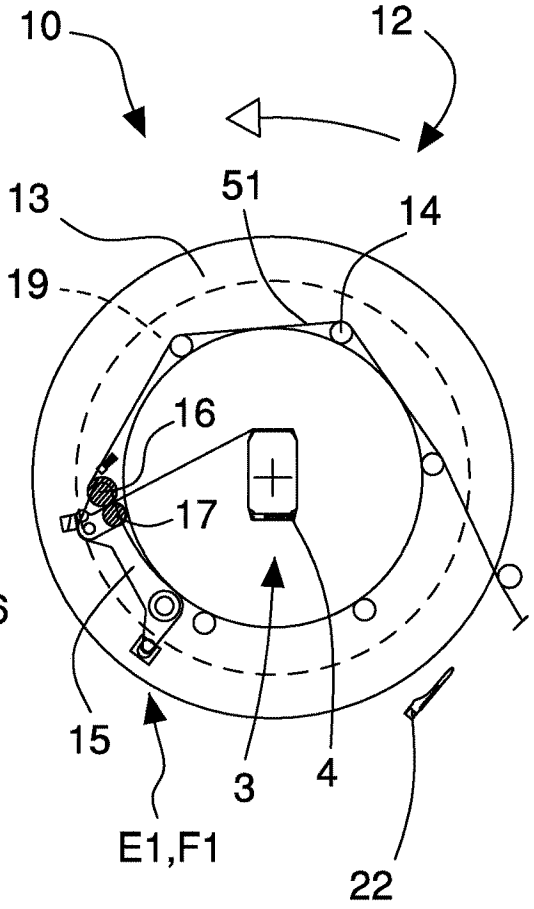
Figure 15:
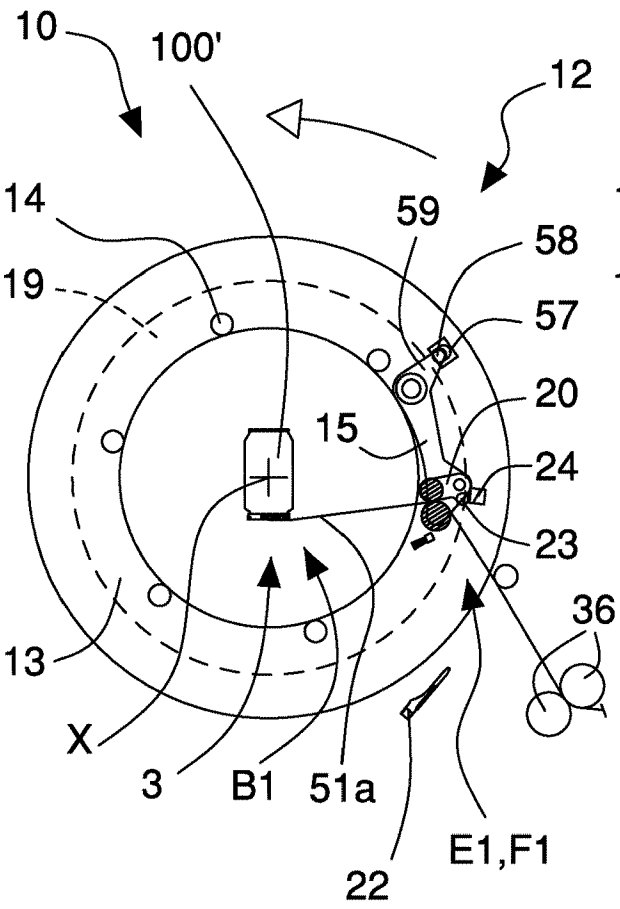
Figure 20:
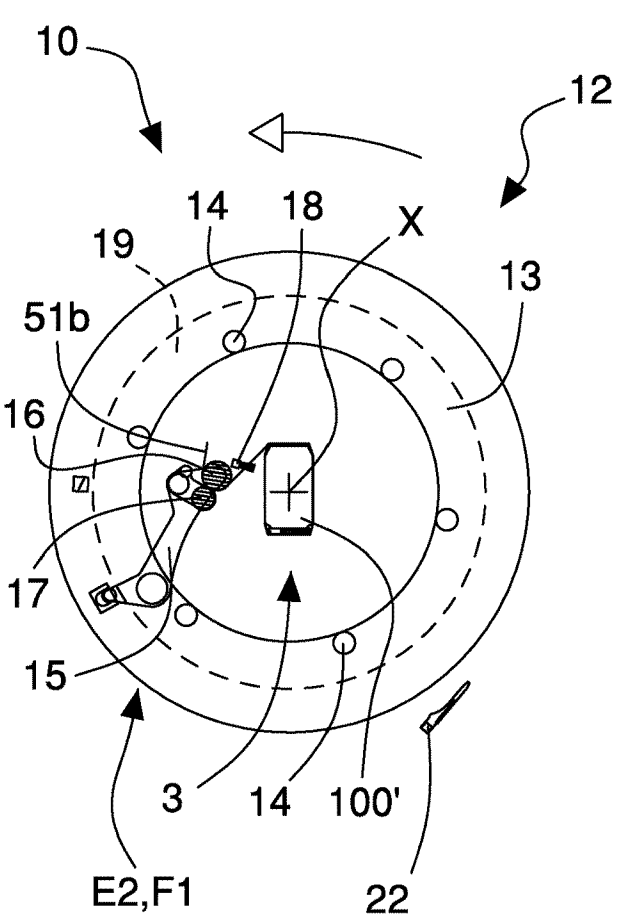
Figure 19:
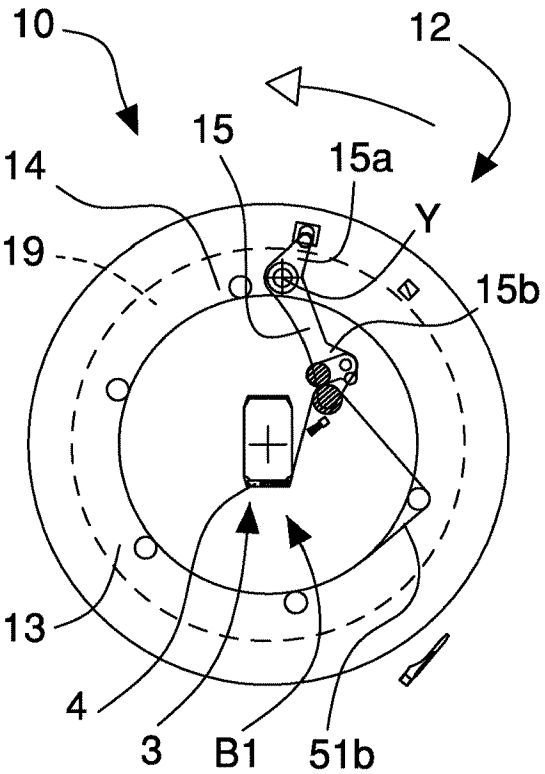
Figure 18:
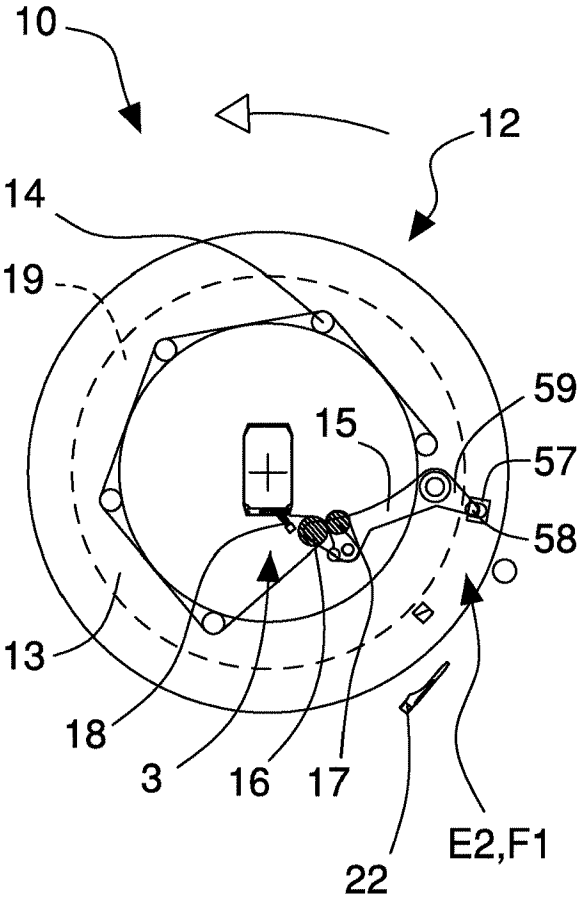
Figure 22:
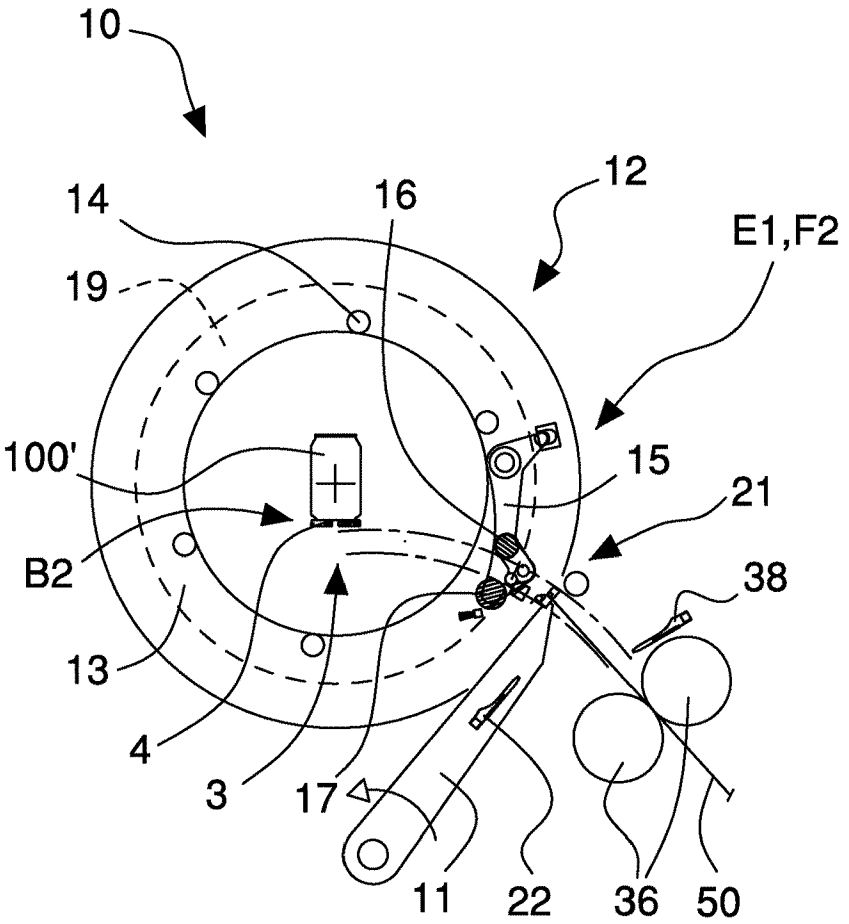
FIGS. 22 to 24 are schematic and partial side views of the wrapping unit in a film setting step.
Figure 21:
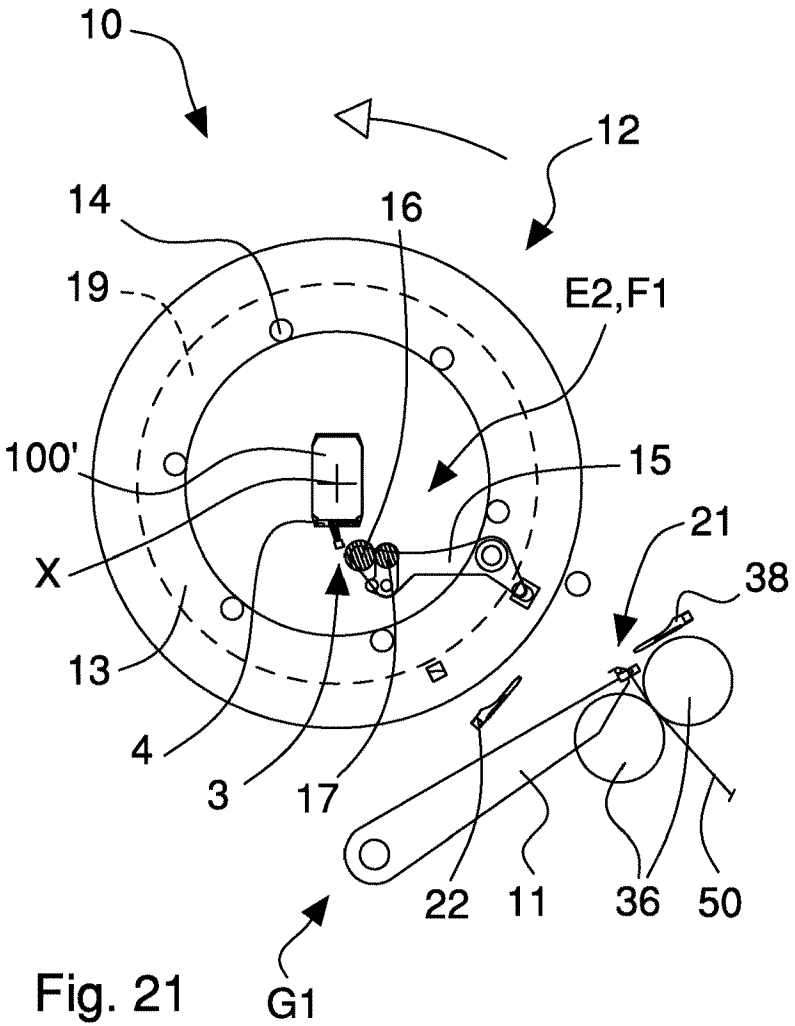

The wrapping procedure (shown in the FIGS. 15 to 24 for another products or container 100' of small size, for example a can) provides a first step wherein the supporting ring 13, by rotating around the wrapping axis X, unwinds and draws the film portion 50 from the supplying unit 30 and wraps a first tract of said film portion 51 provided with the initial flap 51*a* (blocked by the supporting elements 4) around the group of products 100 and a second tract of said film portion 51 provided with the terminal flap 51*b* around the wrapping rollers 14 (FIGS. 15 and 16). The unwinding arm 15 is positioned in the first operative position E1 to deflect the film portion 51 towards the group of products 100. For this purpose, the driving ring 19 rotates together with, and at the same speed of, the supporting ring 3.

The film portion 51 is wrapped around the group of products 100 and around the supporting elements 4, in particular abuts the first belts 42 along the operative tract T.

Figure 17:
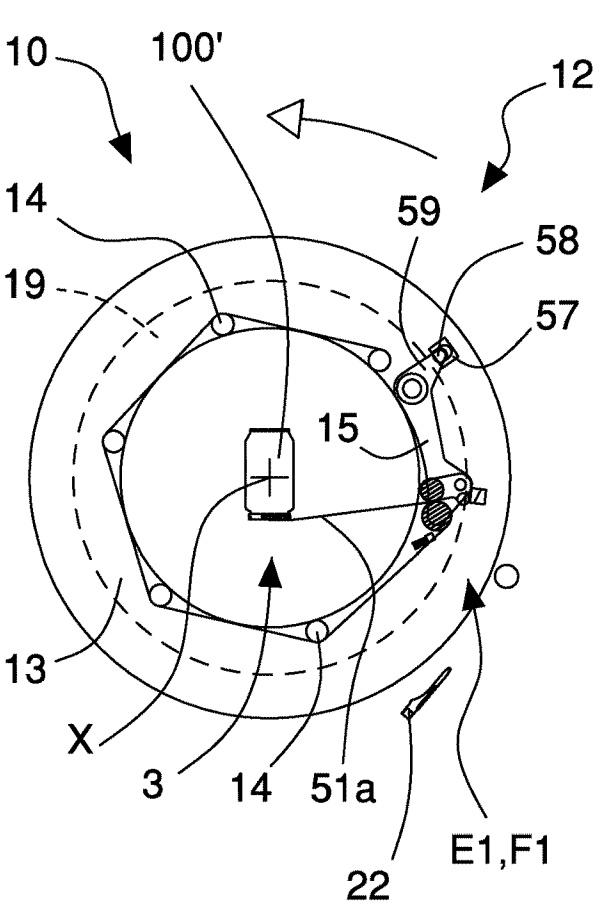
FIGS. 15 to 21 are schematic and partial side views of the wrapping unit in respective wrapping steps of a group of products.

Then, the film portion 41 is detached from the film 50 thanks to the separation line carried out by the cutting means 80. More precisely, while the film portion 51 is wrapped around the wrapping rollers 14, thanks to the rotation of the supporting ring 13, the film 50 is held by the second gripping means 21 of the insertion arm 11, the pulling rollers 36 being blocked. In this way, the film 50 is put under traction and is torn along the separation line in a clear way, allowing the separation of the film portion 51 that can be completely wrapped around the group of products 100 (FIG. 17).

In a second wrapping step, the supporting ring 13, by rotating around the wrapping axis X, wraps the second tract of the film portion 51, drawn and unwound from the wrapping rollers 14, around the group of products 100 in order to complete and form the bundle 200.

In this second wrapping step, the unwinding arm 15 is moved in the operative position E2 wherein the brush means 18 abut and push the film portion 51, in particular the terminal flap 51*b*, to stick on the group of products 100 (FIGS. 18-21). The unwinding arm 15 is moved in the second operative position E2 thanks to the relative rotation of the driving ring 19 with respect to the supporting ring 13.

It should be noticed that the length of the film portion 51 is selected in such a way that the terminal flap 51*a* is applied at the base of bundle 200, i.e. substantially superimposed to the initial flap 51*a*. The correct and desired length of the film portion 51 is verified by sensor means of the supplying unit 3, which detect the unwinding of the film portion, for example exiting the dispensing rollers 36.

The bundle 200 is carried out with a plurality of film turns, the different turns sticking to the products 100 and to each other thanks to the adhesiveness of the same film, which is preferably made of a plastic material containing a suitable adhesive. The film adhesiveness guarantees that the terminal flap 51*b* remains attached to the bundle 200 at the end of the wrapping. The brush means 18 allow the film sticking to the products 100 in optimal way.

The compactness of the wrapping is guaranteed also by the resilient return of the film 50 subjected to pre-stretching or extension when exiting the supplying unit by means of the pre-stretching rollers 33, 34. In fact, once placed and wrapped around the products 100, the film 50 tends to shrink and return to the original length in that way stabilizing and compacting the bundle 200.

It should be noticed that, since the length of the film portion 51 is preset, defined according to dimensions and/or shape of products 100 and since the initial flap 51*a* and the terminal flap 51*b* can be positioned in defined positions with respect to the group of products 100 (at the base), it is possible to use for the wrapping a film 50 made of extensible plastic material having printings, writings, drawings, decorations or the like, which in the bundle 200 will be placed in the desired positions, for example on the sidewalls or on the top.

Once finished the wrapping, the guiding means 5 are moved from the releasing position D2 to the seizing position D1 to abut and laterally support the bundle 200 exiting the wrapping unit 10. In fact, the bundle 200 is pushed along the advancing direction A outside the wrapping unit 10 by the subsequent group of products 100 positioned upstream and in turn pushed and moved by a respective pushing crossbeam 26 (FIG. 6).

The abutting rods 61 of the guiding means 5 enter between the guiding protrusions 67, 67' of the couple of lateral panels 65 of second guiding means 6.

Therefore, the bundle 200 is transferred on the second conveyor means 7. The first moving belts 42 of the supporting elements 4 are rotatably driven to allow the bundle 200 disengaging from the supporting elements. In particular, the first belts 42 are driven in such a way to move at the operative tract T along the advancing direction A together with the bundle 200, this allowing the progressive disengagement of the film wrapped around said second belts 42.

Likewise, the second moving belts 62 of the abutting rods 61 of the guiding means 5 are driven in order to move the bundle 200 in the advancing direction A. At the same time, the same guiding means 5 are moved from the seizing position D1 to the releasing position D2.

In this way, the bundle 200 is easily transferred from the supporting means 3 inside the wrapping unit 10 to the second conveyor means 7, disengaging from the supporting elements 4.

The second conveyor means 7 transport the bundle 200 exiting the wrapping machine 1 along the advancing direction A.

The group of products 100 that has pushed the bundle 200 out of the wrapping unit 10 is positioned on the supporting means 3 to be wrapped.

At the end of the wrapping and before the transfer of the bundle 200 from the supporting means 3 to the second conveyor means 7, the supporting elements 4 are positioned in the opening position B2 to allow the release of the initial flap 51*a* and therefore of the bundle 200 and the subsequent insertion of the initial flap 51*a* of a next film portion 51 dispensed by the supplying unit 30 to wrap the subsequent group of products 100.

Figure 4:
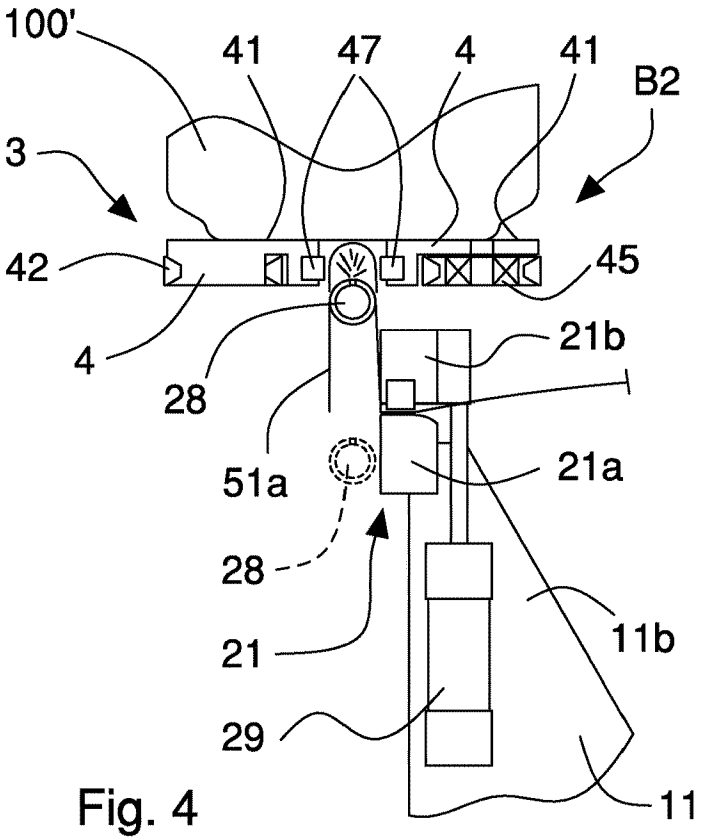
FIG. 4 is an enlarged and partial view of the wrapping unit and the film supplying unit of FIG. 3 in an operating step.

Therefore, before the wrapping an initial setting step of the film portion 51 is provided wherein the wrapping arm 15 is brought back in the first operative position E1 and the second unwinding roller 17 is moved in the disengagement position F2, i.e. it is spaced from the first unwinding roller 16 so as to allow the passage of the second gripping means 21 of the insertion arm 11. In fact, the second gripping means 21 are closed to hold the initial flap 51*a* of a subsequent film portion 51 to be unwound and separated from the film 50. Then, the insertion arm 11 is moved from the gripping position G1 to the transferring position G2 wherein it is adjacent to the supporting means 3 so as to transfer the initial flap 51*a* to the supporting means (FIGS. 21-24). More precisely, in the transferring position G2 of the insertion arm 11, the second gripping means 21 are facing the supporting elements 4 mutually spaced in the opening position B2 to allow inserting the initial flap 51*a* inside them. The initial flap, which is folded by the second blowing means 38 around the insertion bar 28 of the insertion arm 11, after the breaking of film 50 and the separation of the previous film portion 51, is pushed between the two supporting elements 4 by the insertion bar 28, which is moved to approach the supporting means 3, and by a compressed air jet dispensed from the same insertion bar 28 (FIG. 4). While the air jet is dispensed, the two supporting elements 4 are moved in the closing position B1 so as to block and hold the initial flap 51*a*. At the same time, the insertion bar 28 is brought back in a respective retracted position wherein it is more distant from the supporting means 3.

Then, the insertion arm 11 is brought back in the gripping position G1, with the second gripping means 21 in the opening position to allow the passage of film 50 during the wrapping. At the same time, the second unwinding roller 17 is moved in the abutting position F1 in order to engage the film portion 51 with the first unwinding roller 16.

Hence, the wrapping means 12 can be activated to wrap the film portion 51 around the group of products 100 so as to form the bundle 200.

It should be noticed that during the operation of the wrapping machine 1, an almost depleted film reel 55 could be easily replaced with a new film reel without the need to stop the operation thanks to the joining means 85 of the supplying unit 30. In fact, the joining means allow joining the head flap of the new reel to the tail flap of the almost depleted reel 55. The depleted reel can be removed from the supplying unit 30 and replaced with a new reel during the operation of the wrapping machine, which uses the other reel.

Therefore, the wrapping machine 1 has a high productive autonomy, since it is not bound to the substitution of the film reels 55.

By placing the film reel 55 on the side of the machine, inside the supplying unit 30, there is also a remarkable reduction of the rotating masses of the wrapping means 12 (supporting ring 13 and driving ring 19) with respect to the known wrapping apparatuses provided with a rotating supporting ring, this allowing to increase the performances of the wrapping machine (rotational speed, acceleration) and/or to reduce the energy consumption of the motors used for rotating the rings. The smaller masses rotated by the rings also allow to reduce the structural stresses of the wrapping unit extending its operating life and diminishing the damaging risks.

Thanks to the wrapping machine 1 of the invention it is therefore possible to effectively and efficiently wrap groups of products 100 in bundles 200 using a film 50 made of cold extensible plastic material.

Moreover, the wrapping machine allows wrapping groups of products 100 using a printed film 50, i.e. provided with writings, drawings, decorations or the same. In fact, the film portion 50 having a predetermined length can be positioned in a precise and reproducible way around the products 100, this allowing placing writings, drawings, decorations or the same in the desired positions on the bundle 200.

The wrapping machine 1 of the invention is versatile and flexible since allows wrapping in bundles, in a precise and efficient way, groups of products having different sizes and dimensions, without requiring complicated and difficult adjustment and/or setting operations. In fact, it is sufficient to modify the position of the wrapping means 12 (i.e. the position of support ring 13 and drive ring 19) with respect to the supporting plane M in order to arrange the products 100 to be wrapped in the optimal wrapping position.

Figure 25:
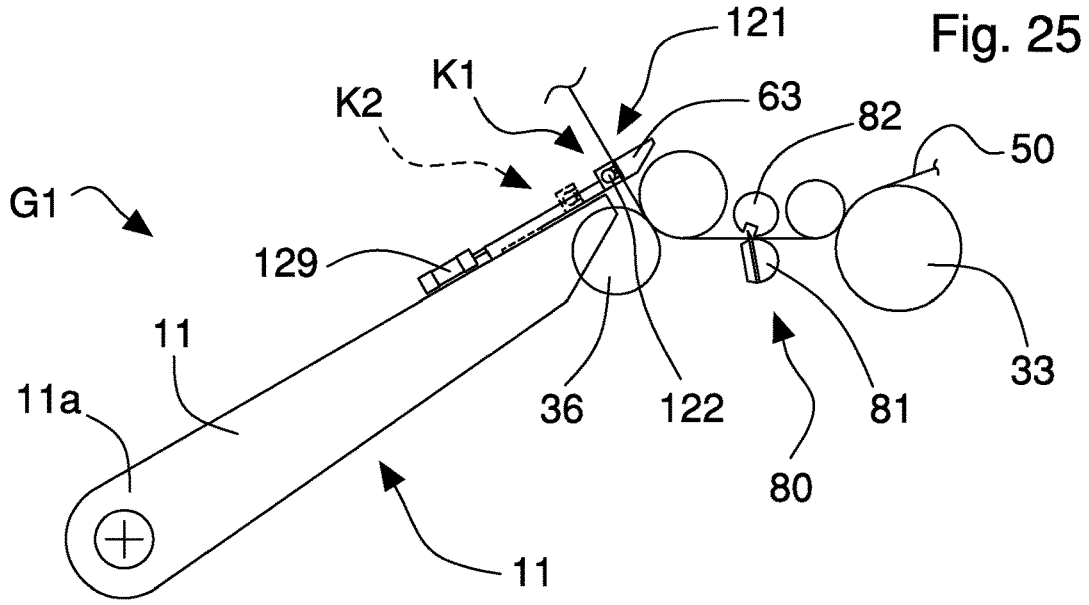
FIG. 25 is a partial side view of a variant of the wrapping machine of the invention that shows an insertion arm of the wrapping unit.

FIG. 25 shows a variant of the wrapping machine 1 of the invention, which differs from the above-described embodiment in the insertion arm 11 that is provided with second gripping means 121 comprising a gripping bar 122 having a shape that is elongated and transversal to the film 50 and provided with air suction means suitable to hold by depression or suction the initial flap 51*a* of the film portion 51. The gripping bar 122, for example, has a quadrangular cross-section and has an abutting wall for the film on which a plurality of openings of the suction means are made that are in flow connection with a suction unit, for example a vacuum pump, of the wrapping machine 1. The gripping bar 122 is movably mounted on the insertion arm 121 and is linearly driven along a direction almost orthogonal to the film 50, between an extended position K1 and a retracted position K2, by a respective linear actuator 129, for example a pneumatic cylinder.

With the insertion arm 11 in the gripping position G1, the gripping bar 122 is moved in the extended position K1 to abut and hold the film 50. For this purpose, the gripping bar 122 pushes the film 50 against a fixed elongated counter element 163 of the supplying unit 30.

In the retracted position K2, the gripping bar 122 allows the free movement of the film 50 and allows the insertion arm 11 rotating between the gripping position G1 and the transferring position G2.

With the insertion arm 11 in the transferring position G2, the gripping bar 122 is moved in the extended position K1 in order to transfer the initial flap 51*a* to the first gripping means 4 of the supporting means 3. For this purpose, the air suction through the openings of the gripping bar 122 is stopped and through the latter compressed air is emitted, which pushes the said initial flap 51*a* against the first gripping means 4, more specifically inside the cavity or slot formed by the two supporting elements 4 positioned in the opening position B2.

Once grabbed the initial flap 51*a*, by moving the supporting elements 4 in the closing position B1, the gripping bar 122 can be brought back in the retracted position K2 in order to allow the insertion arm 11 rotating in the gripping position G1.

Figure 26:
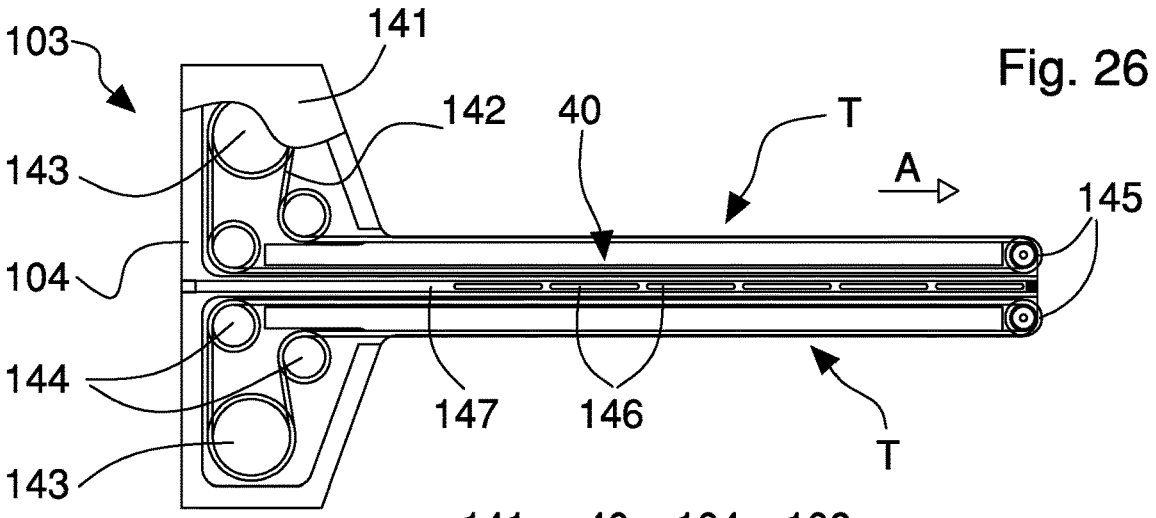
FIG. 26 is a partial plan view of another variant of the wrapping machine of the invention showing the supporting means of the groups of products.
Figure 27:
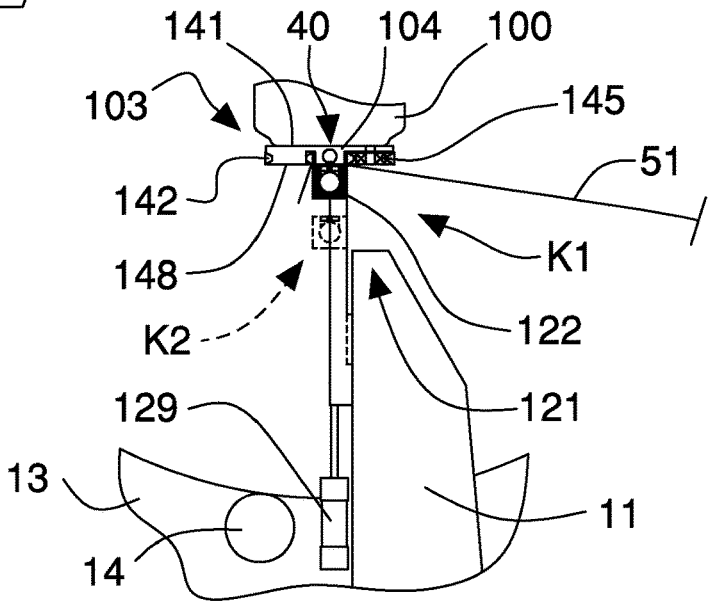
FIG. 27 is a schematic and partial side view of the wrapping unit of the wrapping machine of FIG. 26 showing the insertion arm and the supporting means in an operative step.

FIGS. 26 and 27 show another variant of the wrapping machine 1 of the invention that differs from the embodiment of FIGS. 1 to 25 in the insertion arm 11, the supporting means 103 and the related first gripping means 104.

The insertion arm 11 is the one provided with second gripping means 121 with suction means, above described and shown in FIG. 25.

The supporting means 103 include first gripping means formed by a single supporting element 104 having a substantially shape elongated in the advancing direction A and comprising a supporting wall 141, which forms the supporting plane M for the group of products 100, and air suction means 40, arranged to suck and hold by depression the initial flap 51*a* of the film portion 51 during the wrapping. The suction means 40 comprise a plurality of respective openings or slots 146 made and flowing out on a base wall 148 of the supporting element 104, opposite to the supporting wall 141, and in flow connection with a suction unit, for example a vacuum pump, of the wrapping machine 1. More precisely, the suction means comprise a duct 147 that is made inside the supporting element 4, extends in the advancing direction A and is provided with through openings 146. The duct 147 is in flow connection with the suction unit.

The supporting means 103 further include a couple of first moving belts 142 associated to the supporting element 104, which are flexible, endless and arranged for being abutted along respective operative tracts T by the film portion 51 during the wrapping. The first belts 142 are driven in such a way to move at the respective operative tracts T along the advancing direction A together with the bundle 200 exiting the wrapping unit 10 in order to allow the bundle 200 disengaging from the supporting element 4. Each first belt 142 is wrapped around a plurality of pulleys 143, 144, 145 rotating around respective axes that are orthogonal to the supporting wall 141, i.e. to the supporting plane M. Each first belt 142 has an abutting surface that is almost orthogonal to the supporting wall 141 and that can be engaged in the operative tract T by the film portion 51 wrapped around the group of products 100.

In the operative tracts T, the first belts 142 exit from the supporting element 4 on opposite sides thereof in order to abut the film portion 51.

Inside the supporting element 4, each first belt 142 is wrapped around a respective first pulley 143, rotated by a respective first motor, a couple of respective second return pulleys 144 and a respective third return pulley 145, the return pulleys 144, 145 being rotatable and idle.

The operation of this variant of wrapping machine 1 of the invention is substantially identical to the one of the embodiment described above and shown in FIGS. 1-24, differing only in the diverse functionality of the second gripping means 121 of insertion arm 11 and the first gripping means 104 of supporting means 103.

During the wrapping, the insertion arm 11 is positioned in the gripping position G1, the gripping bar 122 is moved in the extended position K1 in order to abut and hold the film 50 when the latter is stopped to allow the separation of the film portion 51 along the separation line, said film portion 51 being drawn by the wrapping means 12 rotating. In such a way, the film flap generated by the separation, which corresponds with the film initial flap of the subsequent film portion (still connected to the film 50 to be unwound from the reel 55), is held and blocked by the second gripping means 121. In particular, the gripping bar 122 pushes the film 50 against the counter element 163 of the supplying unit 30 and it is moved in the retracted position K2 after grabbing the film 50 by depression or suction.

At the end of the wrapping, and in particular in a setting step of a following wrapping, the insertion arm 11 is moved in the transferring position G2 in which the gripping bar 122 is moved in the extended position K1 to abut the bottom wall 148 of the supporting element 104 in order to transfer and give the initial flap 51*a* of the film portion 51 to the suction means 40 of the supporting element 104. For this purpose, the air suction through the openings of the gripping bar 122 is stopped and instead compressed air is emitted which push the initial flap 51*a* towards the respective openings of the suction means 40 of the supporting element 104 in which the air suction is activated so as to firmly hold the initial flap 51*a* of the film portion 51.

The gripping bar 122 is then brought back in the retracted position K2 to allow the insertion arm 11 rotating from the transferring position G2 to the gripping position G1.

Figures 28, 29:
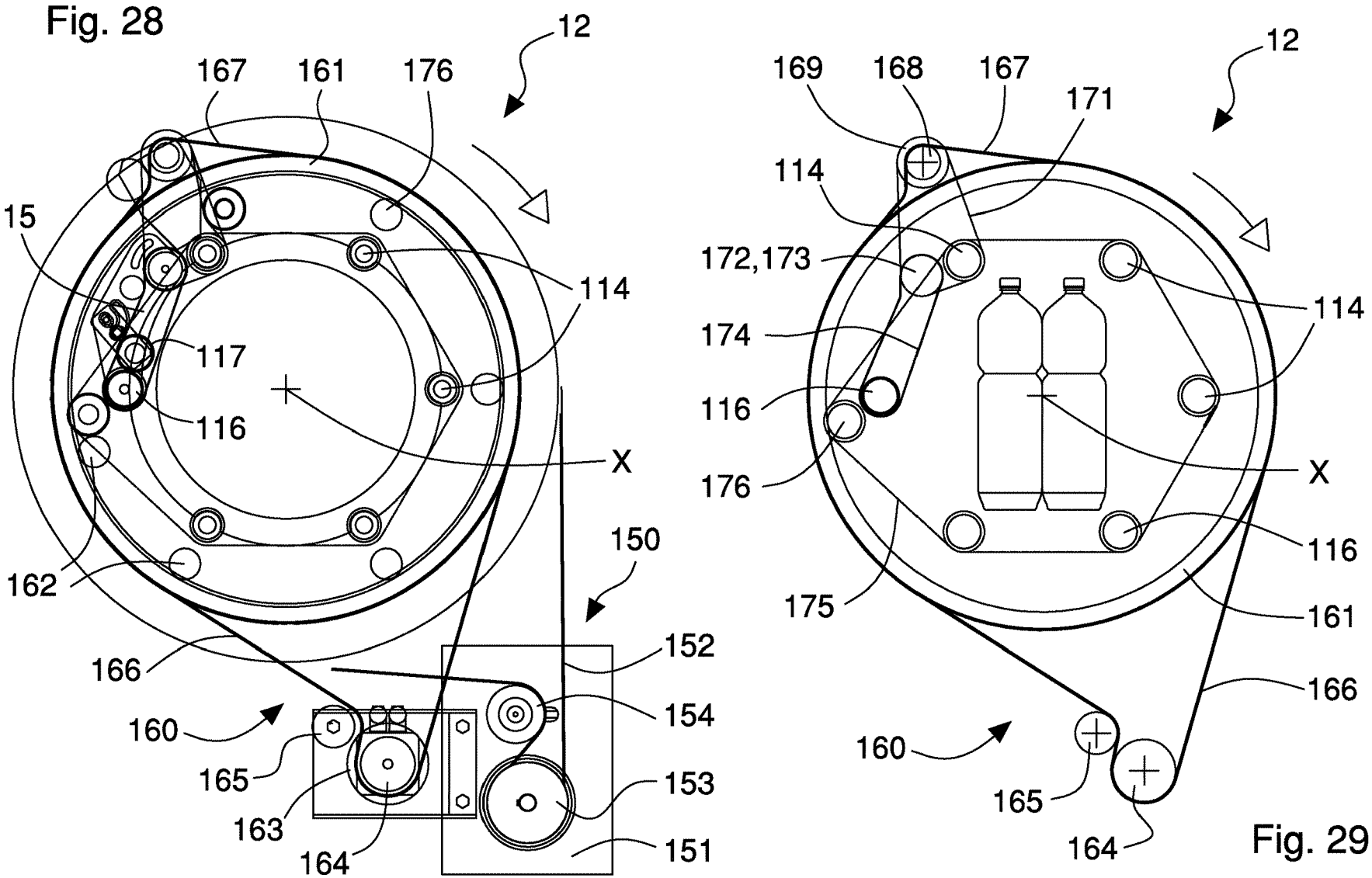
FIG. 28 is a schematic side view of a further variant of the wrapping machine of the invention that shows wrapping means of the products.
FIG. 29 is a schematic side view of the variant of the wrapping machine of FIG. 28 that shows driving means of the wrapping means.

With reference to FIGS. 28 and 29, a further variant of the wrapping machine 1 of the invention is shown which differs from the embodiment above described and shown in FIGS. 1 to 25 in the wrapping means 12 of the wrapping unit 10, wherein the wrapping rollers 114, mounted in a cantilever way on the supporting ring 13, and the first unwinding roller 116, mounted in a cantilever way on the unwinding arm 15, are motorized, i.e. rotated by respective driving means around the respective longitudinal axes, which are parallel to the wrapping axis X. More precisely, first driving means 160 are provided for rotating the wrapping rollers 114 and the first unwinding roller 116 and second driving means 150 are provided for rotating the supporting ring 13, rotatably supported by the frame means 9.

The second driving means 150 comprise, for example, a first rotating electric motor 151, which rotates a first driving belt 152 wrapped around the supporting ring 13 through a first driving pulley 153 and a first return pulley 154.

In the embodiment shown in the figures, the first driving means 160 comprise a transmission ring 161 that is mounted on the supporting ring 13, free to rotate around the wrapping axis X, by means of a plurality of supporting rolls 162. A second rotating electric motor 163 rotates a second driving belt 166 that is wrapped around the transmission ring 161 through a second driving pulley 164 and a second return pulley 165. Around the ring, a third transmission belt 167 is wrapped which engages and rotates a first driven pulley 168, rotatably fixed to the frame means 9. To the first driven pulley 168 a third driving pulley 169 is coaxially fixed which, through a fourth driving belt 171, rotates one of the unwinding rollers 114 and a second driven pulley 172 that is fixed to the unwinding arm 15 and drives a fourth driving pulley 173 coaxially fixed thereto. The fourth driving pulley 173 rotates the first unwinding roller 116 of the unwinding arm 5 through a fifth driving belt 174. A sixth driving belt 175 wraps and connects the wrapping roller 114, driven by the fourth driving belt 171, to the remaining wrapping rollers 114 (and to a third return pulley 176). Preferably, the driving belts and the pulleys are of the toothed type in order to guarantee a precise and regular motion transmission.

The wrapping rollers 114 and the first unwinding roller comprise respective ring gears (not shown) around which the respective driving belts are wrapped and engaged.

Hence, the first driving means 160 of the wrapping machine of the invention allow rotating the wrapping rollers 114 and the unwinding roller 116 in an independent and autonomous way with respect to the supporting ring 13, i.e. in an independent and autonomous way with respect to the wrapping speed of the portion 51 of film 50 around the products 100.

The wrapping rollers 114 and the first unwinding roller 116 are rotated in order to facilitate the unwinding of the portion 51 of film 50 from the supplying unit 3 and the contextual wrapping of said portion 51 around the products 100. Moreover, by sticking to and moving the film portion 51 during the wrapping, the wrapping rollers 114 and in particular the first unwinding roller 116 (in combination with the second unwinding roller 117) also allow regulating the film tension especially in proximity of the products 100.

There is provide a variant, not shown in the figures, in which the wrapping rollers 14 are free to rotate, i.e. they are idle and only the first wrapping roller 116 is rotated around its own longitudinal axis by the first driving means 160.

FIG. 30 shows another variant of the wrapping machine 1 of the invention which differs from the embodiment above described and shown in the FIGS. 1 to 25 in the wrapping means 12 of the wrapping unit 10 which include one or more abutting belts 130 that are arranged, during the rotation of supporting ring 13 around the wrapping axis X, to abut, and wrap around, the wrapping rollers 14 that progressively are positioned on an upper arc 13*a* of said supporting ring 13 that is above the products 100, in order to maintain the film portion 51 strictly adherent to the wrapping rollers 14 and in particular to prevent the disengagement of the terminal flap 51*b* of the portion 51 after the latter exits the supplying unit 30. Preferably, there is provided a plurality of wrapping belts 130 that are arranged parallel and spaced from each other along the direction of the wrapping axis X in order to stick the film on the wrapping rollers 14 for the whole width of the film. Each abutting belt 130 is endless and wound around two lower return pulleys 131 and two upper return pulleys 132, fixed to the frame means 9 of the wrapping machine 1 in such a way to stick to the wrapping rollers 14 on the upper arc 13*a* of said supporting ring 13. The abutting belts 130 are moved by the wrapping rollers 14 in the same direction as the rotation direction of the supporting ring 13, i.e. the wrapping direction of the film portion 51 around the products 100.

With reference to FIG. 31, still another variant of the wrapping machine 1 of the invention is provided which differs from the previously described embodiment in the unwinding means 32 and the cutting means 80 of the supplying unit 30 and in the insertion arm 11.

In this variant of the machine, the unwinding means 32 comprise a couple of pre-stretching rollers 33, 34, motorized and capable to unwind and pre-stretch the film 50, at least one return roller 35 to deflect the film 50 from the reel towards the pre-stretching rollers 33, 34 and a couple of pulling rollers 136, 137 arranged downstream of the pre-stretching rollers 33, 34 to dispense the film portion 51 to the wrapping unit 10.

The pre-stretching rollers comprise a first fast pre-stretching roller 33 positioned downstream of a second slow pre-stretching roller 34 in such a way to stretch or extend the film 50 by a preset percentage (according to the rotation speed difference between the two rollers). The pre-stretching rollers 33, 34 are rotated by at least one motor and are abutted by respective abutting rollers 133 and 134, for example mounted on an elastic or adjustable support not shown, which assure the right adhesion of the film 50 to said pre-stretching rollers 33, 34.

The pulling rollers comprise a first motorized pulling roller 136 and a second idle pulling roller 137 mounted on a respective oscillating arm 138 and therefore movable between an operative position, wherein the second pulling roller 137 presses the film 50 against the first pulling roller 136 to allow the latter maintaining under tension the film tract between the first pre-stretching roller 33 and the pulling rollers 136, 137, and a disengagement position wherein said second pulling roller 137 is spaced from the first pulling roller 136 in order to allow the insertion arm 11 rotating, as better explained in the following of the description.

The cutting means 80 are arranged between the two pulling rollers 136, 137 and the first pre-stretching roller 33 and comprise a cutting roller 181 rotating around a respective axis that is longitudinal and transversal to the unwinding direction of the film; the cutting roller 181 is provided with a blade suitable to transversally cut or shear the film 50 so as to obtain the portion 51 of film 50 having a suitable length.

The free end of the insertion arm 11 is provided with second gripping means 221 comprising a gripping bar 222 that has a shape elongated and transversal to the film 50 and is provided with air suction means capable to hold by depression or suction the initial flap 51*a* of the film portion 51 that is generated as a result of the cut executed by the cutting roller 81. The gripping bar 222 has, for example, a quadrangular cross-section and has an abutting wall for the film 50 on which a plurality of openings of the suction means are carried out that are in flow connection with a suction unit, for example a vacuum pump, of the wrapping machine 1. The gripping bar 222 further has a counter portion 222*a* having a formed shape which receives the film tract that is sheared by the cutting roller 181.

It should be noted that the cut makes the terminal flap 51*b* of the portion 51 of film 50 that is being wrapped around the load 100 and the initial flap 51*a* of the subsequent portion 51 of film 50 to be wrapped around a subsequent group of products 100, said initial flap 51*a* being held by second gripping means 221 of the insertion arm 11, positioned in the gripping position G1.

In this variant, the insertion arm 11 also includes an insertion blade 228 positioned at the second gripping means 221 and movable along the insertion arm 11 so as to insert the initial flap 51*a* of the portion 51 between the two supporting elements 4 of the first gripping means positioned in the opening position B2, when the insertion arm 11 is positioned in the transferring position G2 (dashed line in FIG. 31).

It should be noted that in the shown variant, the supporting elements 4 of the supporting means 3 (that act also as first gripping means) do not include mobile abutting belts for the film.

The insertion blade 228 is linearly moved by a respective linear actuator 229, for example a pneumatic cylinder of known type.

In order to allow the insertion arm 11 rotating between the gripping position G1 and the transferring position G2 for transferring the initial flap 51*a* held by the second gripping means 221 to the first gripping means 4, the second pulling roller 137 is moved by rotating the respective oscillating arm 138 in the disengagement position wherein the second pulling roller 137 is spaced from the first pulling roller 136 and does not interfere with the gripping bar 222 and the insertion blade 222 of the insertion arm 11.

Figure 33:
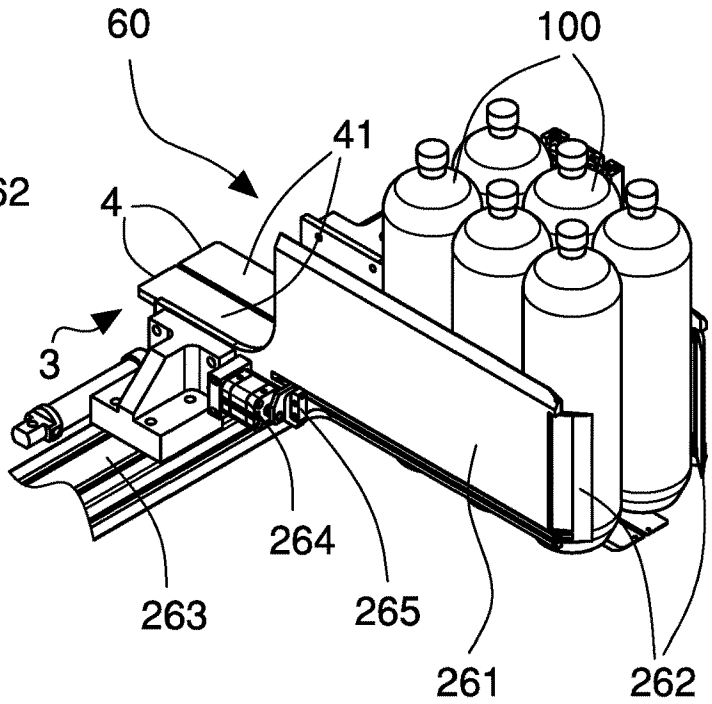
FIGS. 32 and 33 are respectively a side view and a perspective view of supporting means and containment means of the products of another variant of the wrapping machine of the invention.
Figure 32:
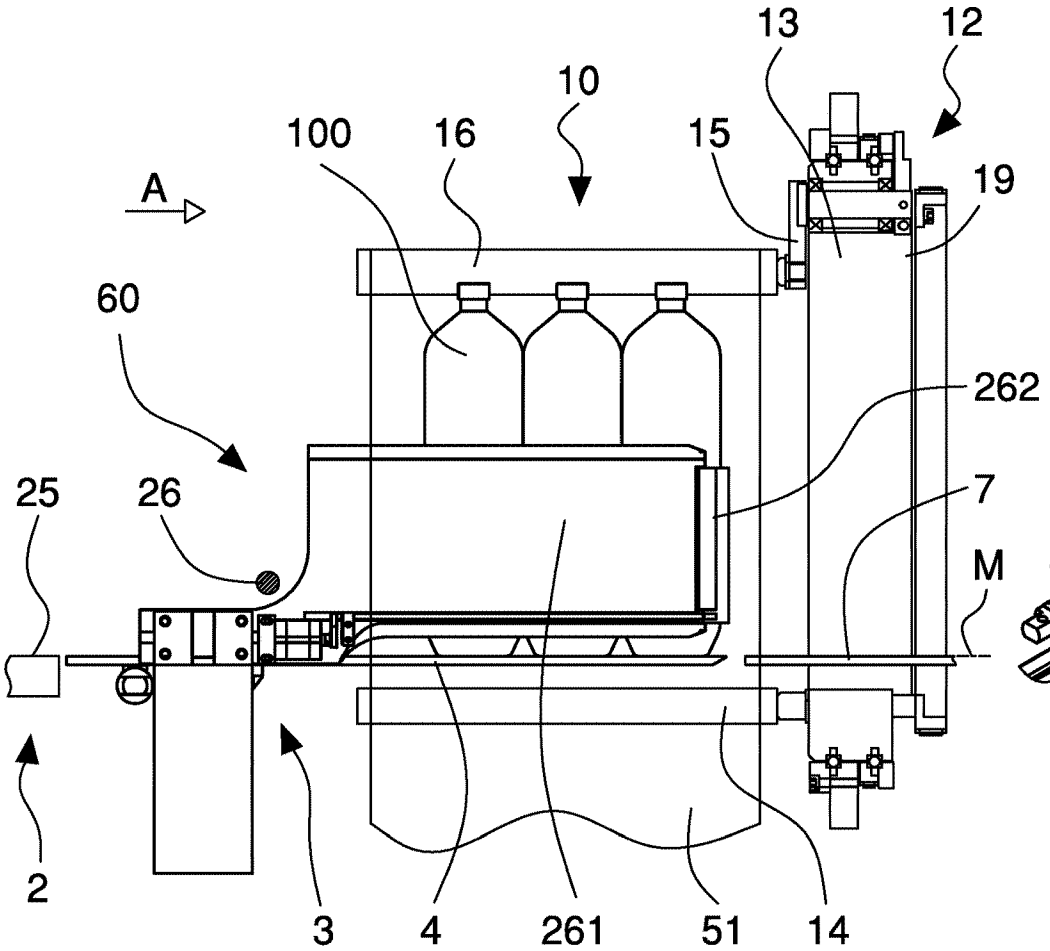
Figure 34:
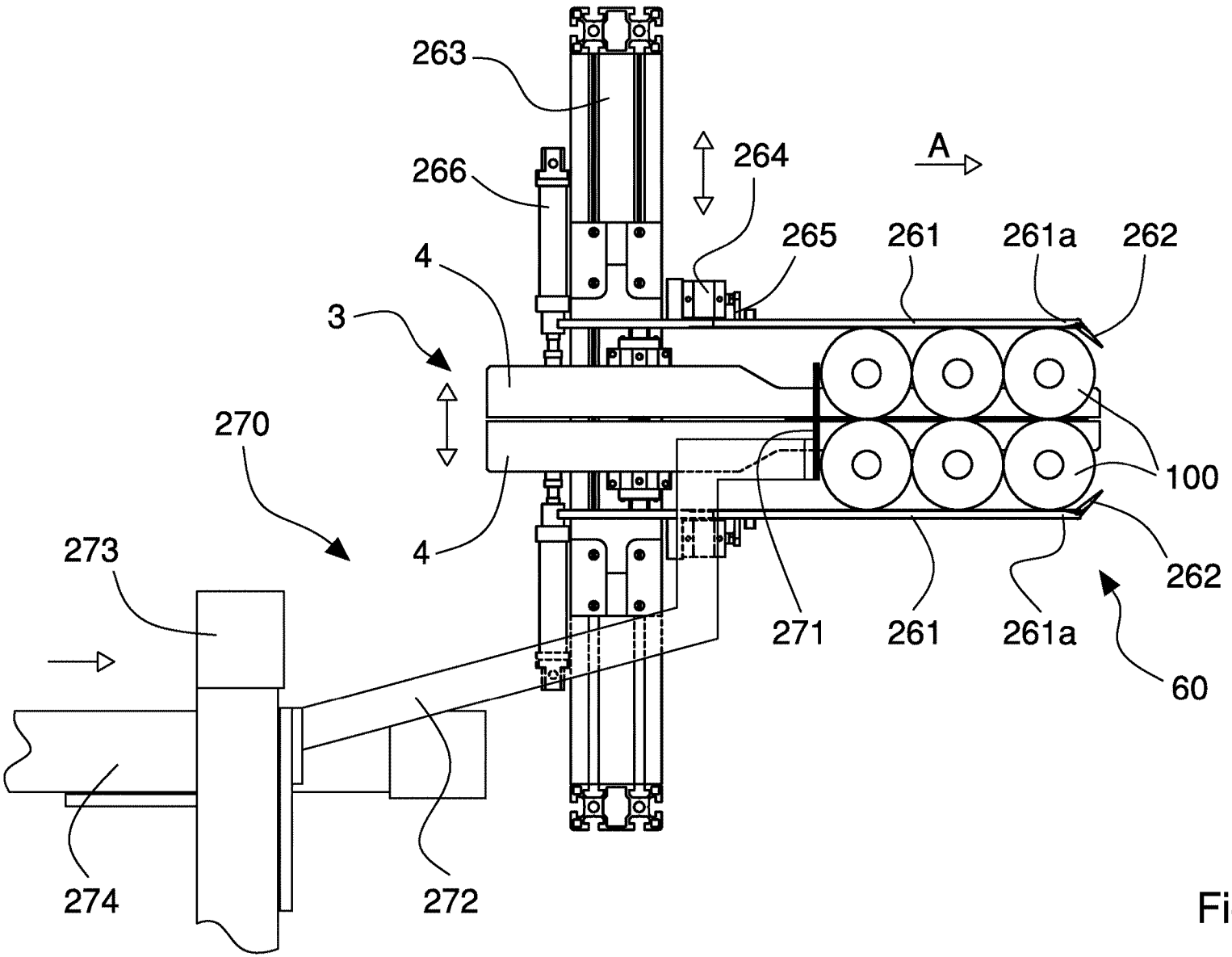
FIG. 34 is a top plan view of the supporting means and the containment means of the variant of FIGS. 32 and 33.

With reference to FIGS. 32 to 34, another variant of the wrapping machine 1 of the invention is shown that differs from the embodiment described above and shown in FIGS. 1 to 25 in the different containment means 60 of the products 100 and in that it does not include guiding means arranged for abutting sidewalls of the products and guiding the latter ones exiting the wrapping unit 10.

Also in this variant, the products 100, which form the group or load to be wrapped, are positioned on the supporting plane M formed by the supporting means 3 and the conveyor means 2, 7, but since they are unstable, they must be supported by the containment means 60 when entering the wrapping unit 10 and during the wrapping step. The containment means include a couple of lateral panels 261 that abut the sidewalls of products 100 inside the wrapping unit 10. The transversal position, i.e. along a direction orthogonal to the advancing direction A of the products, can be adjusted according to the dimensions of the products 100 or the bundle 200 being formed. For this purpose, the two lateral panels 261 are mounted on a lateral guide 263 along which they can be moved and then opportunely blocked.

Each lateral panel 261 comprises a terminal edge 261*a* adjacent to the second conveyor means 7 (provided downstream of the wrapping unit 10 in order to support and move the products along the advancing direction A and exiting the wrapping machine 1) to which a respective abutting door 262 is rotatably fixed that is movable to block the products 100 moving along the advancing direction A, in particular during the wrapping. More precisely, each abutting door 262 is fixed to the terminal edge 261*a* of the respective lateral panel 261 in such a way to rotate around a substantially vertical axis between a closing position, wherein the abutting door is rotated and turned towards the opposite lateral panel 261 in order to block the products 100 moving along the advancing direction A, and an opening position, wherein the abutting door is almost aligned to the respective lateral panel 261 in order to allow the products 100 moving along the advance direction A and therefore coming out from the wrapping unit 10. A respective actuator 264, for example of pneumatic type, is provided for rotating each abutting door 262 by lever means 265.

In this variant of the wrapping machine 1, the first gripping means 4 are integrated with the supporting means 3 and comprise two supporting elements 4 that are adjacent and opposed and form the supporting plane M. The supporting elements 4 are moved by respective linear actuators 266, for example pneumatic cylinders or linear electric motors, transversally to the advancing direction A, between the closing position B1 and the opening position B2.

With particular reference to FIG. 34, the wrapping machine 1 includes further pushing means 270 acting upstream of the group of products 100 that are partially introduced inside the wrapping unit 10 by the pushing means 26 (pushing crossbeams) of the first conveyor means 2. The further pushing means 270 push the products 100, slidably supported by the supporting walls 41 of the supporting elements 4 and by the lateral panels 261, until compacting them against the abutting doors 262 positioned in the closing position, which in this way form a fixed reference line for the following wrapping of the products 100 with the film 50.

The further pushing means 270 comprise a pushing plate 271 suitable to abut the sidewalls of the products 100 farther from the abutting doors 262. The pushing plate 271 is supported by a supporting lever 272 having a formed shape and moved by actuating means 273, 274 in such a way to disengage from the products 100 and from the wrapping unit 10, after compacting, without colliding with a subsequent group of products 100 advancing along the supporting means 3. The actuating means include, for example, a first linear actuator 273 that supports and moves linearly the supporting lever 272 along a direction transversal to the advancing direction A and a second linear actuator 274 that supports and moves the first linear actuator 273 parallel to the advancing direction A. By controlling in a suitable way the two linear actuators 273, 274 it is possible to move the supporting lever 272 and thus the pushing plate 271 with a suitable desired interpolated trajectory, in particular exiting the wrapping unit 10.

The operation of this variant of wrapping machine 1 provides to transfer the group of products 100 from the first conveyor means 2 to the supporting means 3 of the wrapping unit 10 by means of the pushing crossbeams 26. The further pushing means 270 operate in order to compact and push the products 100 inside the wrapping unit 10 against the abutting doors 262 of the containment means 60, positioned in the closing position. The lateral panels 261 keep the products 100 (for example bottles) in a stable and erected position both during the transfer on the supporting means 3 and during the wrapping with the portion 51 of film 50. Before starting the wrapping, the pushing plate 271 of the further pushing means 270 is disengaged from the products 100 and removed from the wrapping unit 10 in order to not to interfere with the film being unwound.

During the operation of the wrapping means 12, the portion 51 of film 50 is wrapped around the group of products 100 and also around the lateral panels 261 and the abutting doors 262. However, thanks to the elasticity of the film 50 and the flat and elongated shape of the lateral panels 261 and the abutting doors 262, it is possible to easily disengage the bundle 200 from the containment means 60 (with the abutting doors 262 positioned in the opening position) at the end of the wrapping and to transfer the bundle from the supporting means 3 to the second conveyor means 7. In particular, the products 100 wrapped with the film are pushed out of the wrapping unit 10 along the advancing direction A by an incoming group of products 100 to be wrapped, positioned upstream and in turn pushed and moved by a respective pushing crossbeam 26.

Figure 35:
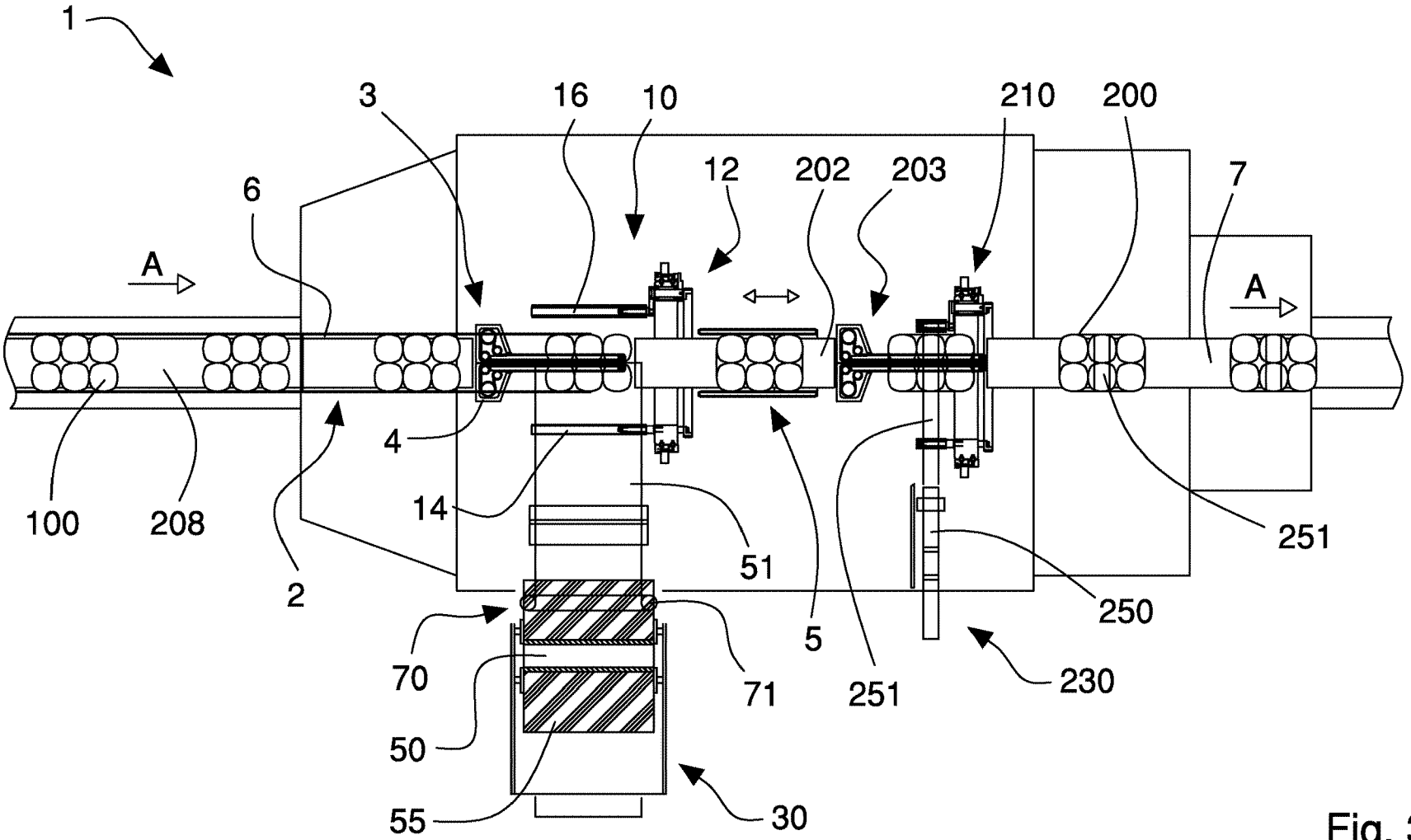
FIG. 35 is a schematic top plan view of a further variant of the wrapping machine of the invention.

FIG. 35 shows another embodiment of the wrapping machine 1 of the invention which differs from the embodiment above described and shown in FIG. 1 in that it includes feeding conveyor means 208, which are arranged parallel and aligned to the first conveyor means 2 along the advancing direction A, and a further wrapping unit 110 positioned downstream of the wrapping unit 10 for wrapping the bundle 200 with a tape or strap 250 made of plastic film in order to form at least one ring for the user to grab and transport it. The further wrapping unit 210 is substantially identical to the wrapping unit 10 having wrapping rollers and gripping rollers of the wrapping means 212 having a reduced length, being reduced the width of tape 250.

Third conveyor means 202 are interposed between the wrapping unit 10 and further supporting means 203 being positioned upstream of the further wrapping unit 210 in order to support the bundle 200 and to receive and block a respective initial flap of the tape 250.

The further wrapping unit 210 is supplied by a further supplying unit 230 that is substantially similar to the supplying unit 30, in this case without the pre-stretching rollers that are not needed for elongating the tape or strap 251.

The tape 250 is wrapped one or more times around the bundle 200 in order to form a solid and strong ring for lift and transport and it is fixed to the film of the bundle by means of welding and/or gluing. Preferably, the tape is welded to a lower portion of the bundle 200 through known means not shown and in two or more points of the sidewalls of the bundle.

The invention claimed is:

1. A wrapping machine for wrapping groups of products with an extensible plastic film in order to form bundles, the wrapping machine comprising:

a first conveyor for supporting and moving a group of products along an advancing direction inside the wrapping machine;

a supporting device for receiving from said first conveyor and for supporting a group of products and a first gripping device arranged to hold an initial flap of a film portion of the extensible plastic film when wrapping the group of products;

a wrapping unit for wrapping the film portion having a preset length around the group of products, supported by said supporting device, in order to form a bundle;

a supplying unit of the extensible plastic film for supplying said wrapping unit with the film portion having the preset length, separated from the extensible plastic film unwound from a respective reel; and a containment device arranged to abut at least sidewalls of the group of products so as to support and guide the group of products when the group of products are moved along the advancing direction through said wrapping unit and/or to support and restrain the group of products during the wrapping with the film portion, wherein said first gripping device includes at least one supporting element of said supporting device, said supporting element comprising a supporting wall forming a supporting plane for the group of products and an air suction system arranged to suck and hold by depression the initial flap of the film portion during the wrapping.

2. The wrapping machine according to claim 1, wherein said wrapping unit comprises an insertion arm that is movable and arranged to grab the initial flap of the film portion coming out from said supplying unit and to transfer the initial flap to said first gripping device in order to be grabbed and blocked by said first griping device, in an initial setting step of the wrapping.

3. The wrapping machine according to claim 2, wherein said insertion arm includes a first terminal portion rotatably fixed to a frame of the wrapping machine and a second terminal portion provided with a second gripping device arranged to hold the initial flap of the film portion, said insertion arm being rotatable between a gripping position, where said insertion arm is adjacent to said supplying unit in order to grab the initial flap, and a transferring position, where said insertion arm is adjacent to said supporting device in order to transfer to the first gripping device thereof the initial flap.

4. The wrapping machine according to claim 1, wherein said wrapping unit comprises a wrapping assembly for unwinding the film portion from said supplying unit and for wrapping the film portion around the group of products.

5. The wrapping machine according to claim 1, wherein said at least one supporting element of said supporting device comprises a plurality of first belts, which are flexible, endless and arranged to be abutted along respective operative tracts by the film portion during the wrapping, said first belts being driven so as to move at the respective operative tracts along the advancing direction together with the bundle coming out from said wrapping unit such that said supporting element disengages from the bundle.

6. The wrapping machine according to claim 1, further comprising a guiding assembly for abutting sidewalls of the bundle and guiding the bundle exiting from said wrapping unit and disengaging from said supporting device, wherein said guiding assembly is movable along the advancing direction between a seizing position, where said guiding assembly abuts the bundle inside said wrapping unit, and a releasing position, where said guiding assembly is spaced from said wrapping unit.

7. The wrapping machine according to claim 1, wherein said supplying unit includes:

a supporting and moving device for supporting and rotating at least one reel of the extensible plastic film;

an unwinding assembly comprising a plurality of rollers for unwinding and pre-stretching the extensible plastic film; and a cutting device for forming on the extensible plastic film a weakening line or cutting line respectively for facilitating a separation of, or for separating, the film portion from the extensible plastic film unwound from the reel.

8. The wrapping machine according to claim 7, wherein said supporting and moving device comprises a first supporting and moving element for supporting and rotating a first reel of the extensible plastic film and a second supporting and moving element for supporting and rotating a second reel of the extensible plastic film, and wherein said supplying unit further comprises a joining device to join a head flap of one of the first and second reels that is new to a tail flap of another of the first and second reels that is almost depleted.

9. A wrapping machine for wrapping groups of products with an extensible plastic film in order to form bundles, the wrapping machine comprising:

a first conveyor for supporting and moving a group of products along an advancing direction inside the wrapping machine;

a supporting device for receiving from said first conveyor and for supporting the group of products and a first gripping device arranged to hold an initial flap of a film portion of the extensible plastic film when wrapping the group of products;

a wrapping unit for wrapping the film portion having a preset length around the group of products, supported by said supporting device, in order to form a bundle;

a supplying unit of the extensible plastic film for supplying said wrapping unit with the film portion having the preset length, separated from the extensible plastic film unwound from a respective reel;

a containment device arranged to abut at least sidewalls of the group of products so as to support and guide the group of products when the group of products are moved along the advancing direction through said wrapping unit and/or to support and restrain the group of products during the wrapping with the film portion; and a further pushing device acting upstream of the group of products, which are partially introduced inside said wrapping unit by a pushing device of said first conveyor, and arranged to push the group of products until the group of products are compacted against abutting doors of said containment device that are positioned in a closing position.

10. The wrapping machine according to claim 9, wherein said containment device comprises a plurality of lateral panels arranged to abut sidewalls of the group of products inside said wrapping unit, said lateral panels having a flat and elongated shape to facilitate disengagement of the bundle and exit thereof from said wrapping unit at an end of the wrapping.

11. The wrapping machine according to claim 10, wherein said containment device further comprises a plurality of abutting doors each of which is rotatably fixed to a respective one of said lateral panels and movable between a closing position, where said abutting door is rotated and turned towards an opposite one of said lateral panels to block the group of products moving along the advancing direction, and an opening position, where said abutting door is at least substantially aligned to said respective lateral panel to allow the group of products to move along the advancing direction and exit from said wrapping unit.

12. The wrapping machine according to claim 9, further comprising a guiding assembly for abutting sidewalls of the bundle and guiding the bundle exiting from said wrapping unit and disengaging from said supporting device, wherein said guiding assembly is movable along the advancing direction between a seizing position, where said guiding assembly abuts the bundle inside said wrapping unit, and a releasing position, where said guiding assembly is spaced from said wrapping unit.

13. The wrapping machine according to claim 12, wherein said guiding assembly comprises at least one pair of abutting rods opposed and parallel to each other and to the advancing direction, said abutting rods being provided with respective second belts, which are endless, arranged to abut opposite sidewalls of the bundle and rotatably driven in order to move the bundle along the advancing direction exiting said wrapping unit.

14. The wrapping machine according to claim 9, wherein said supplying unit includes:

a supporting and moving device for supporting and rotating at least one reel of the extensible plastic film;

an unwinding assembly comprising a plurality of rollers for unwinding and pre-stretching the extensible plastic film; and a cutting device for forming on the extensible plastic film a weakening line or cutting line respectively for facilitating a separation of, or for separating, the film portion from the extensible plastic film unwound from the reel.

15. A wrapping machine for wrapping groups of products with an extensible plastic film in order to form bundles, the wrapping machine comprising:

a first conveyor for supporting and moving a group of products along an advancing direction inside the wrapping machine;

a supporting device for receiving from said first conveyor and for supporting a group of products and a first gripping device arranged to hold an initial flap of a film portion of the extensible plastic film when wrapping the group of products;

a wrapping unit for wrapping the film portion having a preset length around the group of products, supported by said supporting device, in order to form a bundle;

a supplying unit of the extensible plastic film for supplying said wrapping unit with the film portion having the preset length, separated from the extensible plastic film unwound from a respective reel;

a containment device arranged to abut at least sidewalls of the group of products so as to support and guide the group of products when the group of products are moved along the advancing direction through said wrapping unit and/or to support and restrain the group of products during the wrapping with the film portion; and a guiding assembly for abutting sidewalls of the bundle and guiding the bundle exiting from said wrapping unit and disengaging from said supporting device, wherein said guiding assembly is movable along the advancing direction between a seizing position, where said guiding assembly abuts the bundle inside said wrapping unit, and a releasing position, where said guiding assembly is spaced from said wrapping unit.

16. The wrapping machine according to claim 15, wherein said guiding assembly comprises at least one pair of abutting rods opposed and parallel to each other and to the advancing direction, said abutting rods being provided with respective second belts, which are endless, arranged to abut opposite sidewalls of the bundle and rotatably driven in order to move the bundle along the advancing direction exiting said wrapping unit.

17. The wrapping machine according to claim 15, wherein said containment device comprises a plurality of lateral panels arranged to abut sidewalls of the group of products inside said wrapping unit, said lateral panels having a flat and elongated shape to facilitate disengagement of the bundle and exit thereof from said wrapping unit at an end of the wrapping.

18. The wrapping machine according to claim 17, wherein said containment device further comprises a plurality of abutting doors each of which is rotatably fixed to a respective one of said lateral panels and movable between a closing position, where said abutting door is rotated and turned towards an opposite one of said lateral panels to block the group of products moving along the advancing direction, and an opening position, where said abutting door is at least substantially aligned to said respective lateral panel to allow the group of products to move along the advancing direction and to exit from said wrapping unit.

19. The wrapping machine according to claim 18, further comprising a further pushing device acting upstream of the group of products, which are partially introduced inside said wrapping unit by a pushing device of said first conveyor, and arranged to push the group of products until the group of products are compacted against said abutting doors that are positioned in a closing position.

20. The wrapping machine according to claim 15, wherein said supplying unit includes:

a supporting and moving device for supporting and rotating at least one reel of the extensible plastic film;

an unwinding assembly comprising a plurality of rollers for unwinding and pre-stretching the extensible plastic film; and a cutting device for forming on the extensible plastic film a weakening line or cutting line respectively for facilitating a separation of, or for separating, the film portion from the extensible plastic film unwound from the reel.

* * * * *